US008408897B2

(12) United States Patent
Rossi et al.

(10) Patent No.: US 8,408,897 B2
(45) Date of Patent: Apr. 2, 2013

(54) GAS BURNER

(75) Inventors: Carlo Antonio Rossi, Norwoood (AU); Marco Rossi, West Croydon (AU); Steven McIntyre, Westbourne Park (AU); Keith Joseph Borg, Revesby (AU); George Brock-Nannestad, Gentofte (DK)

(73) Assignee: Aktiebolaget Electrolux, Stockholm (SE)

( * ) Notice: Subject to any disclaimer, the term of this patent is extended or adjusted under 35 U.S.C. 154(b) by 550 days.

(21) Appl. No.: 10/597,348

(22) PCT Filed: Feb. 1, 2005

(86) PCT No.: PCT/SE2005/000121

§ 371 (c)(1),
(2), (4) Date: Mar. 16, 2007

(87) PCT Pub. No.: WO2005/073630

PCT Pub. Date: Aug. 11, 2005

(65) Prior Publication Data

US 2008/0241777 A1 Oct. 2, 2008

(30) Foreign Application Priority Data

Feb. 2, 2004 (AU) ..... 2004900464

(51) Int. Cl.
*F23D 14/62* (2006.01)

(52) U.S. Cl. ..... 431/354; 431/284; 431/347; 431/351; 431/352; 431/353; 126/39 R; 126/39 K; 126/214 A; 126/39 H; 126/39 J; 239/594; 239/561; 239/558

(58) Field of Classification Search ..... 431/354, 431/284, 347, 349, 353, 357, 351, 352; 126/39 R, 126/39 K, 214 A, 39 H, 39 E, 41 R, 39 J; 239/594, 561, 558, 555, 548, 553.3
See application file for complete search history.

(56) References Cited

U.S. PATENT DOCUMENTS 2,100,292 A 11/1937 Schneider (Continued)

FOREIGN PATENT DOCUMENTS

DE 435795 C 12/1926
DE 3918715 A1 11/1990

(Continued)

*Primary Examiner* — Avinash Savani
(74) *Attorney, Agent, or Firm* — Pearne & Gordon LLP

(57) ABSTRACT

The present invention provides a gas burner (10) including: a distributor means (50) having at least one distribution chamber to distribute an air gas mixture around said distributor (50), said burner (10) including a plurality of flame ports (70) through which said gas mixture can pass and be ignited; at least one injector (39) associated with said distributor (50), said at least one injector (39) being positioned to inject gas into said at least distribution chamber via a venture formed of a vertically directed passage and transition port (64) and at least one venturi extension extending away from said transition port (64). The present invention also provides manifold for a gas burner (10), said manifold having an upper wall (12) and a lower wall (16) held in spaced apart relationship by a peripheral wall to define a cavity there between, said manifold including means (38) to mount at least one injector (39) so as to deliver an air gas supply to a distribution means (50) and an inlet port (18) to allow connection to a supply of gas, which can pressurize said cavity, said upper (12) and said lower (16) wall being formed from relatively thin sections.

57 Claims, 15 Drawing Sheets

U.S. PATENT DOCUMENTS

| | | | | |
|---|---|---|---|---|
| 2,311,994 | A * | 2/1943 | Parker | 239/288.3 |
| 2,320,754 | A * | 6/1943 | Sherman | 126/39 K |
| 2,506,483 | A * | 5/1950 | Bechtold | 126/39 H |
| 3,042,110 | A * | 7/1962 | Weber et al. | 431/349 |
| 5,002,038 | A * | 3/1991 | Riehl | 126/39 R |
| 5,401,164 | A | 3/1995 | Yen | |
| 5,842,849 | A | 12/1998 | Huang | |
| 6,089,219 | A | 7/2000 | Kodera et al. | |
| 6,244,263 | B1 | 6/2001 | Schlosser et al. | |
| 6,325,619 | B2 * | 12/2001 | Dane | 431/284 |
| 6,332,460 | B1 | 12/2001 | Paesani | |
| 6,439,882 | B2 * | 8/2002 | Haynes et al. | 431/354 |
| 6,604,519 | B1 * | 8/2003 | Bosser | 126/39 J |
| 6,655,954 | B2 * | 12/2003 | Dane | 431/354 |
| 6,663,025 | B1 * | 12/2003 | Halsey et al. | 239/554 |
| 6,688,882 | B1 | 2/2004 | Williams | |
| 7,322,820 | B2 * | 1/2008 | Welton et al. | 431/354 |
| D565,895 | S * | 4/2008 | Pryor et al. | D7/407 |
| 2002/0039713 | A1 | 4/2002 | Dane | |
| 2004/0195399 | A1 | 10/2004 | Molla | |
| 2006/0121402 | A1 * | 6/2006 | Bettinzoli | 431/354 |

FOREIGN PATENT DOCUMENTS

| | | | |
|---|---|---|---|
| EP | 0534301 | A2 | 3/1993 |
| FR | 2650369 | A1 | 2/1991 |
| FR | 2770620 | A1 | 5/1999 |
| JP | 10160127 | | 6/1998 |
| JP | 10185212 | | 7/1998 |
| JP | 11223309 | | 8/1999 |
| JP | 2001296003 | | 10/2001 |
| WO | 2004044490 | A1 | 5/2004 |

* cited by examiner

Fig 10
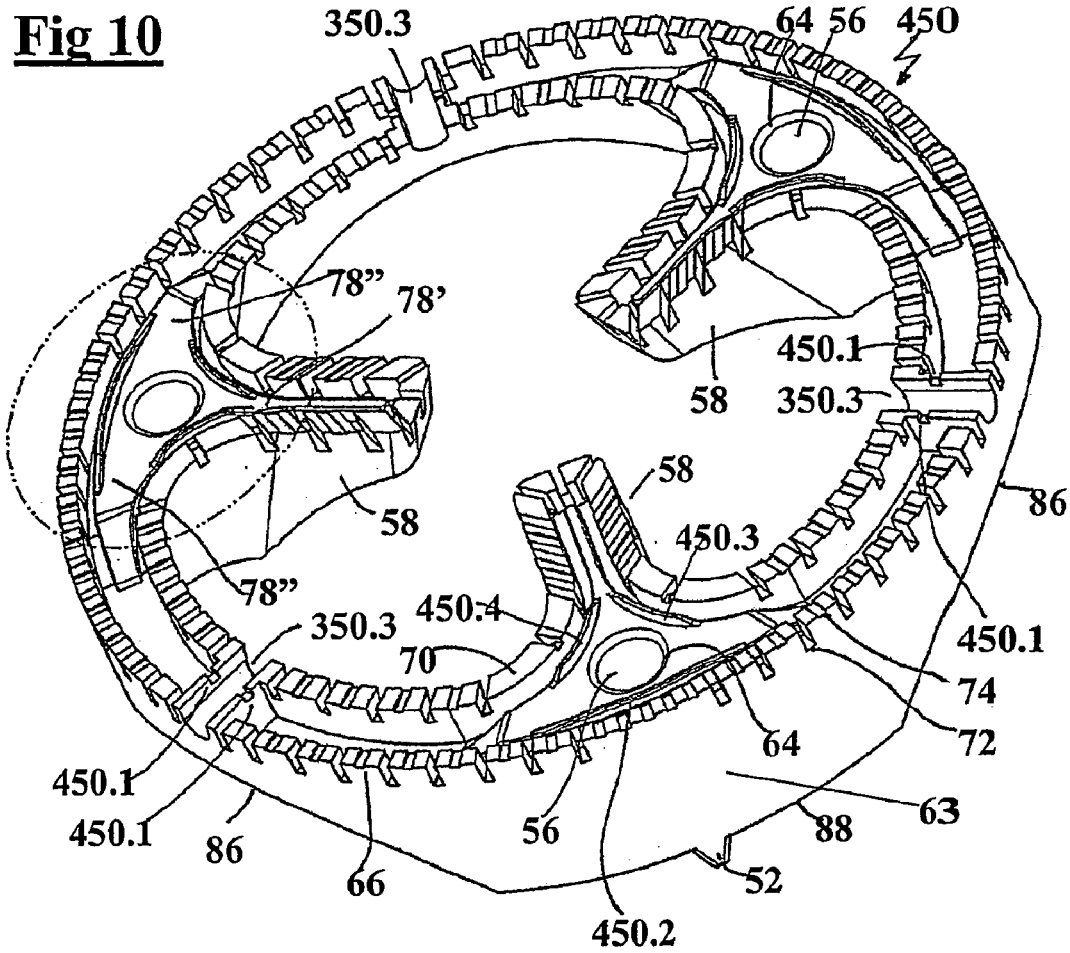
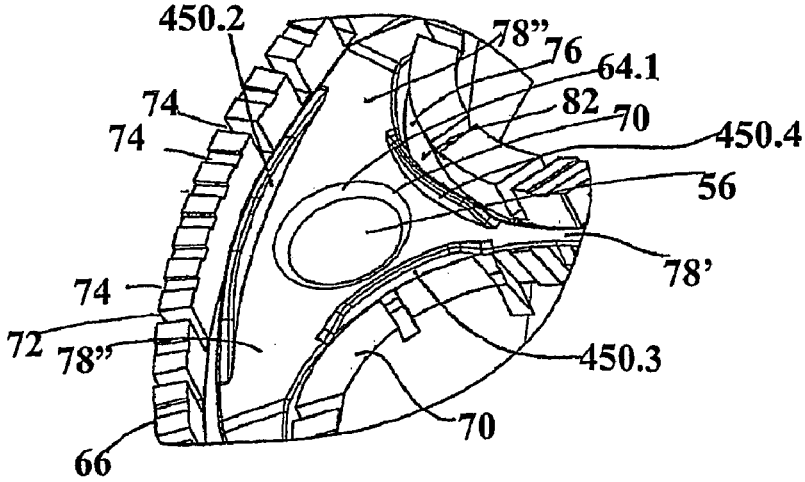
Fig 11

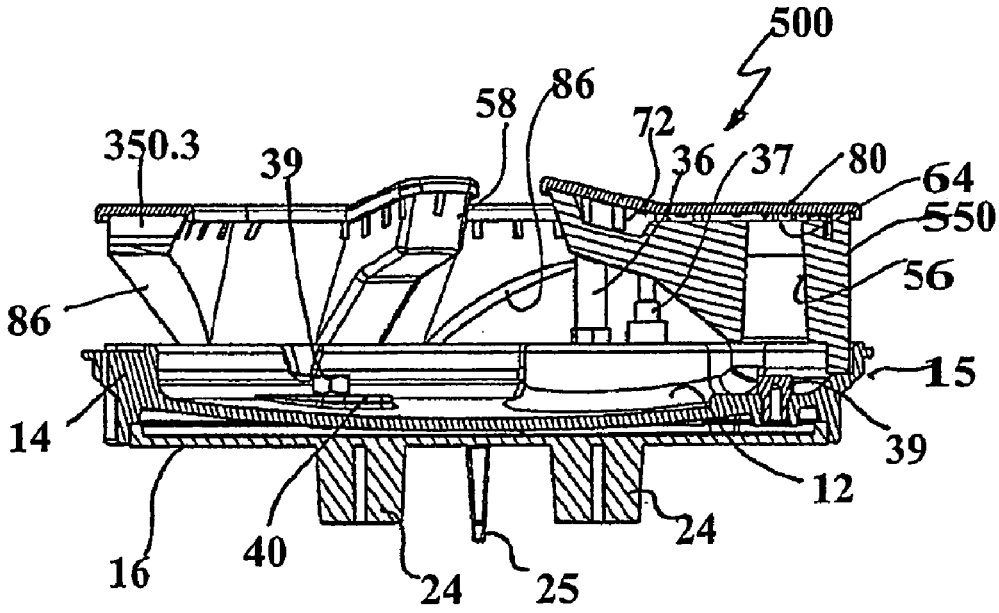
Fig 13
Fig 12
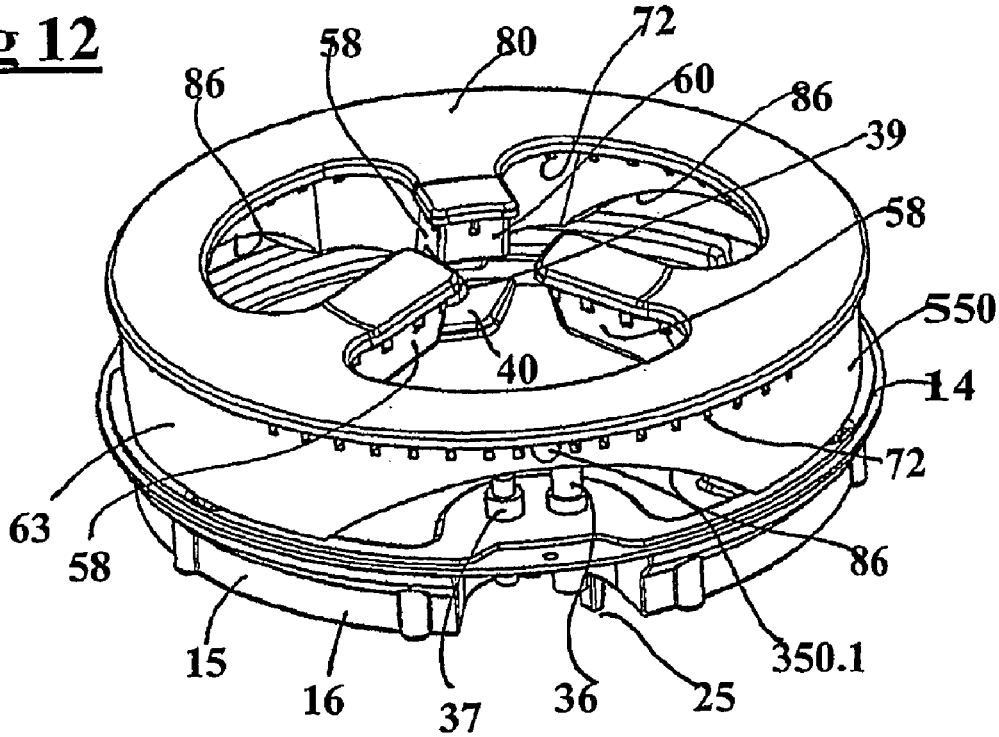

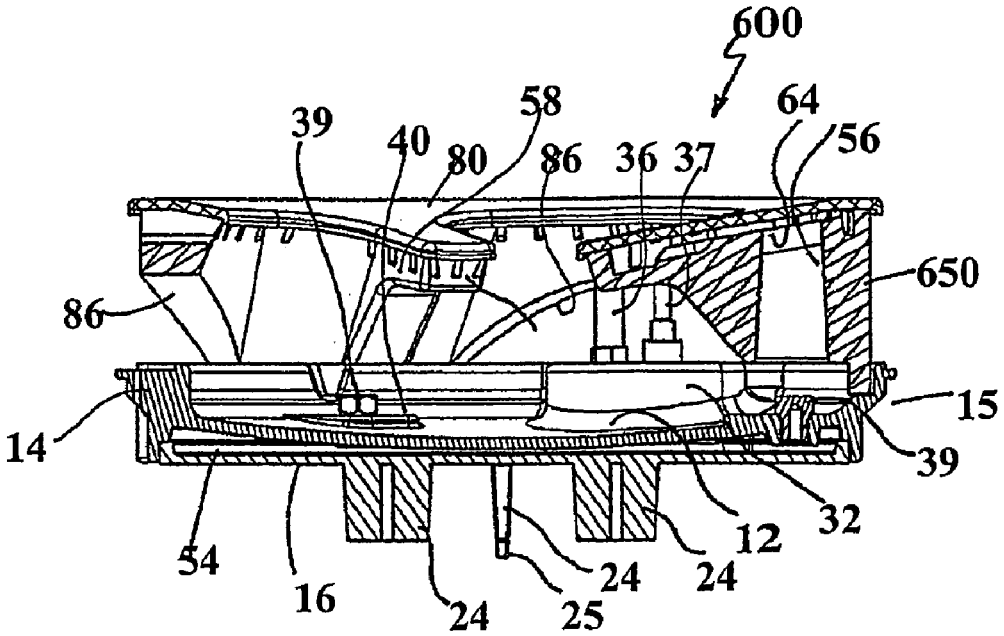
Fig 15
Fig 14
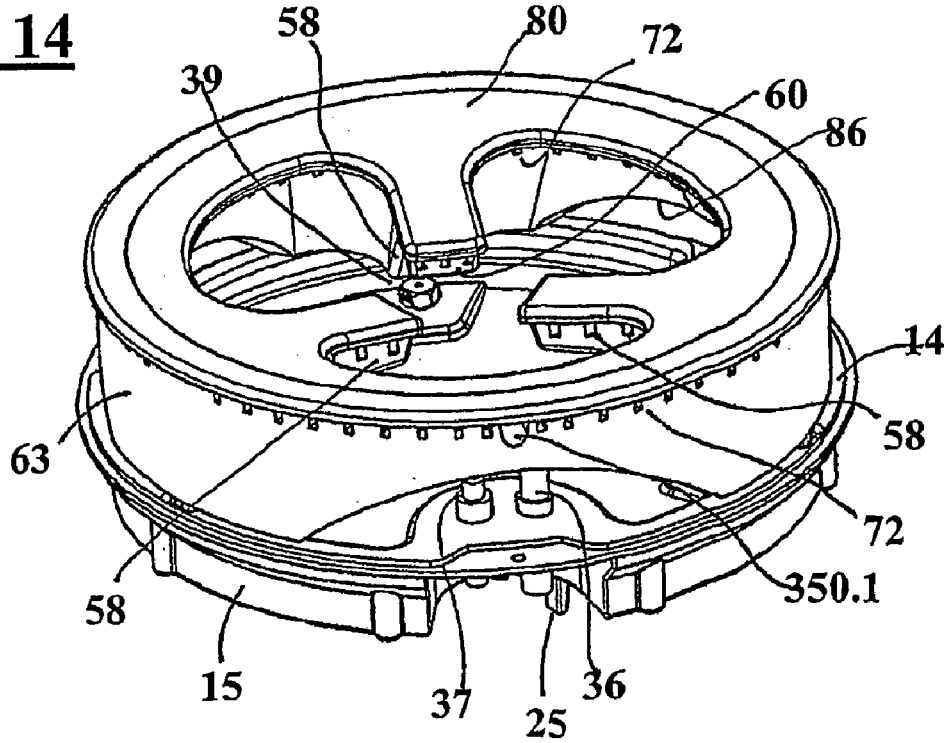

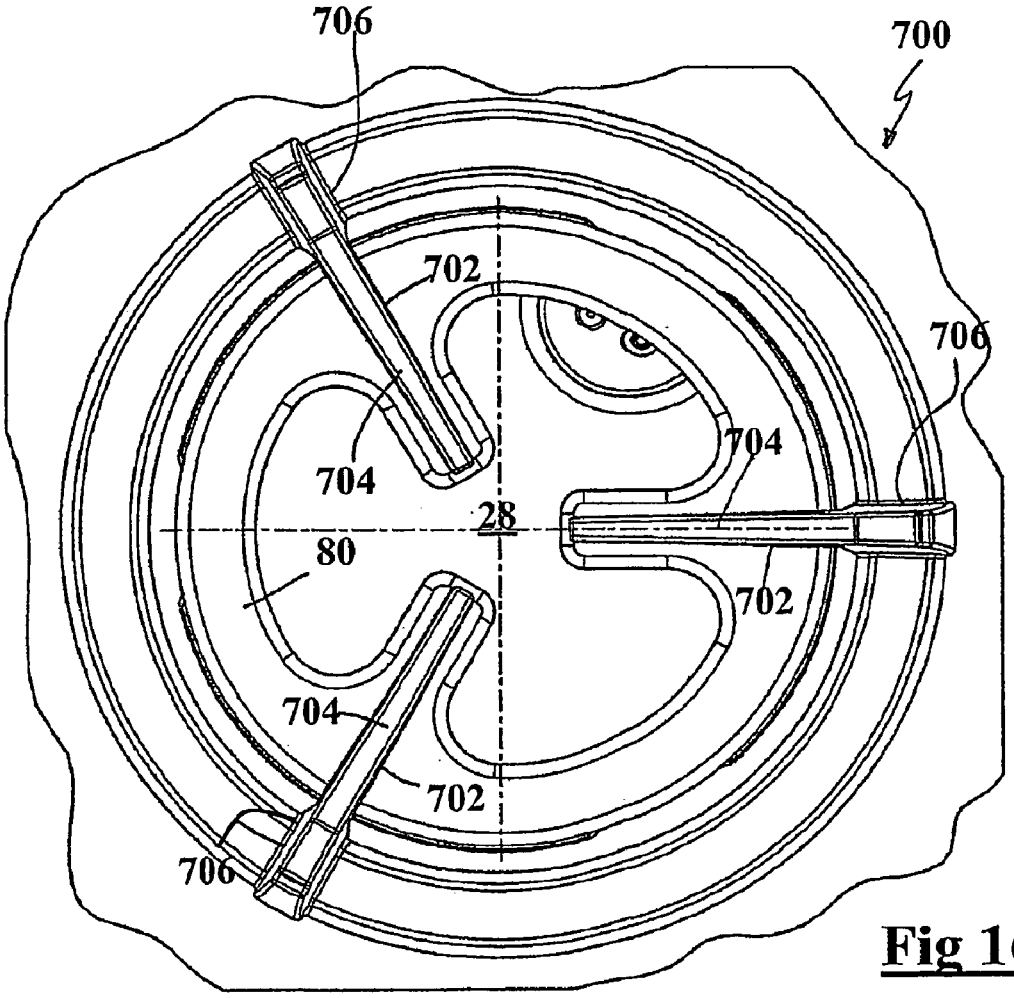
Fig 16
Fig 17
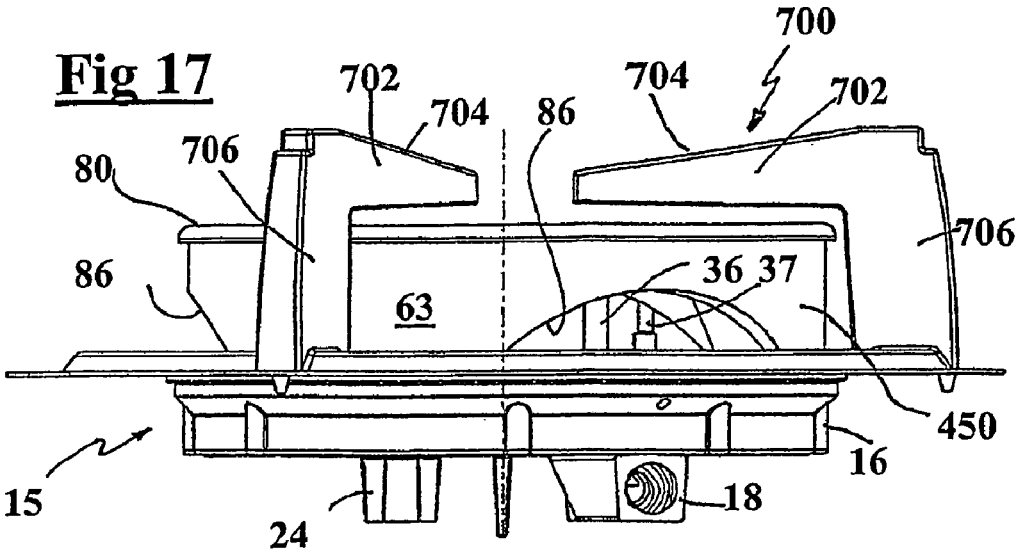

GAS BURNER

FIELD OF THE INVENTION

The present invention relates to gas burners for cooking stoves and in particular to a gas burner suitable for use with a wok.

BACKGROUND OF THE INVENTION

Wok burners are in the main single injector designs and aim at concentrating the heat at the centre of the burner, corresponding to the bottom of the wok. Such burners are known from documented prior art constructions, such as those found in DE3918715 and similar designs, such as U.S. Pat. No. 6,688,882 and U.S. Pat. No. 6,089,219, as well as JP10-185212 and JP10-160127. However, it is common to these constructions that they require a fairly large space below the hob surface to accommodate the injector. Also, most of these designs are not sufficiently adaptable, for instance in cases where it is desired to use one and the same burner configuration as the basis for a burner that could heat up a larger area of a cooking utensil, such as an ordinary cooking pot or frying pan. Even those documents among the above cited that do indeed describe burners for larger areas require a large space below the hob. It is the purpose of the present invention to provide gas burners which are adaptable for use in many variants, answering to various needs of heat distribution. It is a further purpose to provide gas burners that do not take up much space below the hob surface.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a gas burner including: a distributor means having at least one distribution chamber to distribute an air gas mixture around said distributor, said burner including a plurality of flame ports through which said gas mixture can pass and be ignited; at least one injector associated with said distributor, said at least one injector being positioned to inject gas into said at least one distribution chamber via a venturi formed of a vertically directed passage and transition port and at least one venturi extension extending away from said transition port.

There can be two, three or four generally horizontal venturi extensions, which extend in separate directions away from said transition port.

The distributor means can have a generally cylindrical outer surface.

The distributor means can have at least two, or preferably three, equi-spaced inwardly extending arms.

The distributor means can include at least one radially outwardly extending arm.

The flame ports direct streams of air gas mixture towards the centre of said distributor.

The distributor can have an aperture having a clover leaf configuration.

The distributor means can be segmented whereby each segment has its own distribution chamber and injector.

The distributor means can be segmented by means of segment walls between respective segments.

The distributor means can be an assembly of separate or discrete segments which are assembled or otherwise joined together.

The separate or discrete segments can include interlocking formations thereon so that adjacent burner segments can be assembled together. Alternatively or additionally, the separate or discrete segments are held together as an assembly by means of a interaction with a burner cap. Alternatively or additionally a circumferential fixing means assists in holding or holds said separate or discrete segments together as an assembly to form a distributor.

The distributor means can be segmented by means of gas flow from said injectors.

The segments can form one of the following: a cross shape with an arcuate or circumferential cross bar; a T shape with a convex arcuate or circumferential cross bar; a T shape with a concave arcuate or circumferential cross bar.

There can be two venturi extensions which form an arcuate or circumferential shape.

There can be three venturi extensions which form a T shape with an arcuate or circumferential cross bar.

There can be four venturi extensions which form a cross shape with an arcuate or circumferential cross bar.

The at least one venturi extension can be formed as part of said distributor means.

The at least one venturi extension can be formed in a cap which is positioned on top of said distributor means.

The burner can include a cap which is positioned on top of said distributor means.

The flame ports can be formed in one or more walls of said distributor means.

The flame ports can be formed in a cap which is positioned on top of said distributor means.

The at least one venturi extension can have one or more occluding structures associated therewith for directing and or baffling said air gas mixture in its flow from said transition port to said flame ports.

The occluding structures can comprise a wall or ridge like formation extending away from said at least one venturi extension.

The distributor means can have at least one air entry port per injector.

There can be a plurality of air entry ports per injector.

A plurality of air entry ports can be formed in a side wall of said distributor means.

At least one air entry port can have a larger cross sectional area at intermediate regions by comparison to side regions of said air entry ports.

At least one air entry port can be positioned in said wall of said distributor means so as to be located adjacent to said injector.

Each said injector can be shielded by a portion of a wall of said distributor means to prevent air passing in through said air entry port from disturbing the operation of said injector.

The air entry ports can be located between respective arms of said distributor means, and respective injectors are located so that they are aligned with the direction of radial extension of said arm.

The burner can include a trivet which is aligned with said arms, so as to overlie said arms.

The arms can have a flame port arrangement whereby the axis of said flame ports on a respective arm is generally at an acute angle to the radial direction of extension of a respective arm.

The arms can extend away from said distributor means at an angle of inclination or declination away from an imaginary horizontal plane.

The distributor means can be mounted on a manifold including a gas inlet which communicates with a cavity in said manifold, said injectors communicating with said cavity.

The cavity can be convex shaped whereby the height of said cavity at the outer periphery is of a height greater than at the centre of said cavity.

The manifold can have its top surface concave in shape, so as to collect towards the centre of said base spillage which occurs during cooking.

The distributor means can have an internal and an external perimeter, with inwardly directed ports in said internal perimeter and outwardly directed ports in its external perimeter.

The at least one venturi extension can be oriented so as to be generally horizontal.

The present invention also provides a manifold for a gas burner, said manifold having an upper wall and a lower wall held in spaced apart relationship by a peripheral wall to define a cavity therebetween, said manifold including means to mount at least one injector so as to deliver an air gas supply to a distribution means and an inlet port to allow connection to a supply of gas, which can pressurise said cavity, said upper and said lower wall being formed from relatively thin sections.

The upper wall can have a convex surface protruding into said cavity.

The manifold includes one or more ports adapted to receive said at least one injector nozzle.

The upper wall can have a generally concave surface on the outer upper side thereof.

The upper surface of said manifold can also function as a cup to receive spills when cooking.

The present invention further provides a gas burner comprising one distributor means having at least two discrete distribution chambers therein, each chamber having communication with flame ports and including a venturi to supply an air gas mixture thereto; said burner having only one manifold to conduct gas to respective injectors for each venturi from a single gas supply connection to said manifold, each of said chambers having a radially extending portion, which extends inwardly towards the centre of said burner, whereby between the ends of respective radially extending portions there is provided an unobstructed space.

Each radially extending portion can include at least two sides which are generally parallel.

Each chamber can also include two oppositely extending circumferential or arcuate portions.

The chamber can also include a radially outwardly extending portion.

The burner can include a cap.

The distributor means or said cap can include a multiplicity of said flame ports.

The flame ports can be formed by a combination of formations located on said distributor means and said cap.

The chamber can include at least one venturi extension which defines a peripheral channel to deliver air gas mixture to flame ports.

The cap can include at least one venturi extension which extends into said chamber to define a peripheral channel to deliver air gas mixture to flame ports.

Each venturi can include a vertical passage which opens into at least one generally horizontal venturi extension which extends away from said vertical passage in the direction of each respective extending portion of said chamber.

The at least one generally horizontal venturi extension can be formed in said distributor means.

The at least one generally horizontal venturi extension can be formed in an underside of a cap.

The distributor means can be an assembly of separate or discrete segments which are assembled or otherwise joined together.

The separate or discrete segments can include interlocking formations thereon so that adjacent burner segments can be assembled together. Alternatively or additionally, the separate or discrete segments are held together as an assembly by means of a interaction with a burner cap. Alternatively or additionally a circumferential fixing means assists in holding or holds said separate or discrete segments together as an assembly to form a distributor.

The present also provides a gas burner including a distributor having flame ports in a wall portion of said distributor and or in a cap which will cooperate with said distributor, said distributor also including at least two venturis with each venturi having a respective injector associated therewith located internally of and near to a wall portion of said distributor, said distributor including at least two generally elongated air inlet ports which are located in said wall, said ports having a longitudinal axis which extends circumferentially around said distributor, said ports including at their extremities a reduced cross sectional area when compared to the central portions of said port.

A respective injector can be located between opposing ends of said air inlet ports near to a wall portion of said distributor to prevent radially inwardly flowing air from interacting with said injector.

The injectors and said air inlet ports can be arranged with respect to said distributor so that a main stream of radially inwardly flowing air passes through said transition port as secondary air for said flame ports.

The injectors and the air inlet ports can be arranged with respect to said distributor so that air passing through said air inlet ports which will be used as primary air by said injectors approaches said injectors in a generally circumferential direction from said air inlet ports.

The air inlet ports can provide an opening which increases in height to a maximum and then decreases, in circumferential direction around said distributor.

The air inlet ports can be one of the following: eye shaped; diamond shaped; half eye shaped, triangular; a circular segment.

The present invention further provides a gas burner including a distributor means having at least one chamber to distribute an air gas mixture around said distributor means, said burner including a plurality of flame ports through which said gas mixture can pass and be ignited; at least one injector associated with said distributor means, said at least one injector being positioned to inject gas into said at least one chamber via a respective vertically directed converging passage terminating with an transition port which has communication with said chamber, a venturi being formed in part by said converging passage and said transition port with a final part of said venturi being formed by at least one venturi extension which acts upon a generally horizontal flow of said air gas mixture flowing from said transition port, said transition port having at or near its rim two or more occluding structures associated therewith for directing and or baffling said air gas mixture in its flow from said transition port to said flame ports.

The occluding structures can comprise a wall or ridge like formation extending away from said protrusion and or said protrusion extensions.

The occluding structures can have a castellated appearance.

The occluding structures are formed on said distributor means or in a cap associated with said distributor means or by a combination of both.

The flame ports can be formed on said distributor means or in a cap associated with said distributor means or by a combination of both.

Extending away from said transition port there can be at least two venturi extensions.

The occluding structures can be located near to the edges of said venturi extensions.

The venturi extensions can be formed either on said distributor means or in a cap associated with said distributor means or by a combination of both.

The occluding structures can taper toward their extremities.

BRIEF DESCRIPTION OF THE DRAWINGS

An embodiment of the present invention will now be described, by way of example only, with reference to the accompanying drawings, in which:

FIG. 10 illustrates a perspective view of another distributor similar to that of FIG. 9;

FIG. 11 illustrates an enlarged perspective view of a portion of FIG. 10 around the horizontal portion of the venturi;

FIG. 12 illustrates a perspective view of a burner having the inwardly extending arms at an angle of inclination to the horizontal;

FIG. 13 illustrates a diametrical cross section through the burner of FIG. 12;

FIG. 14 illustrates a perspective view of a burner similar to that of FIG. 12 having the inwardly extending arms at an angle of declination to the horizontal;

FIG. 15 illustrates a diametrical cross section through the burner of FIG. 14;

FIG. 16 illustrates a plan view of an assembled burner of previous Figures and a cooperating trivet;

FIG. 17 illustrates a front elevation of the burner and trivet of FIG. 16;

DETAILED DESCRIPTION OF THE EMBODIMENT

Figure 1:
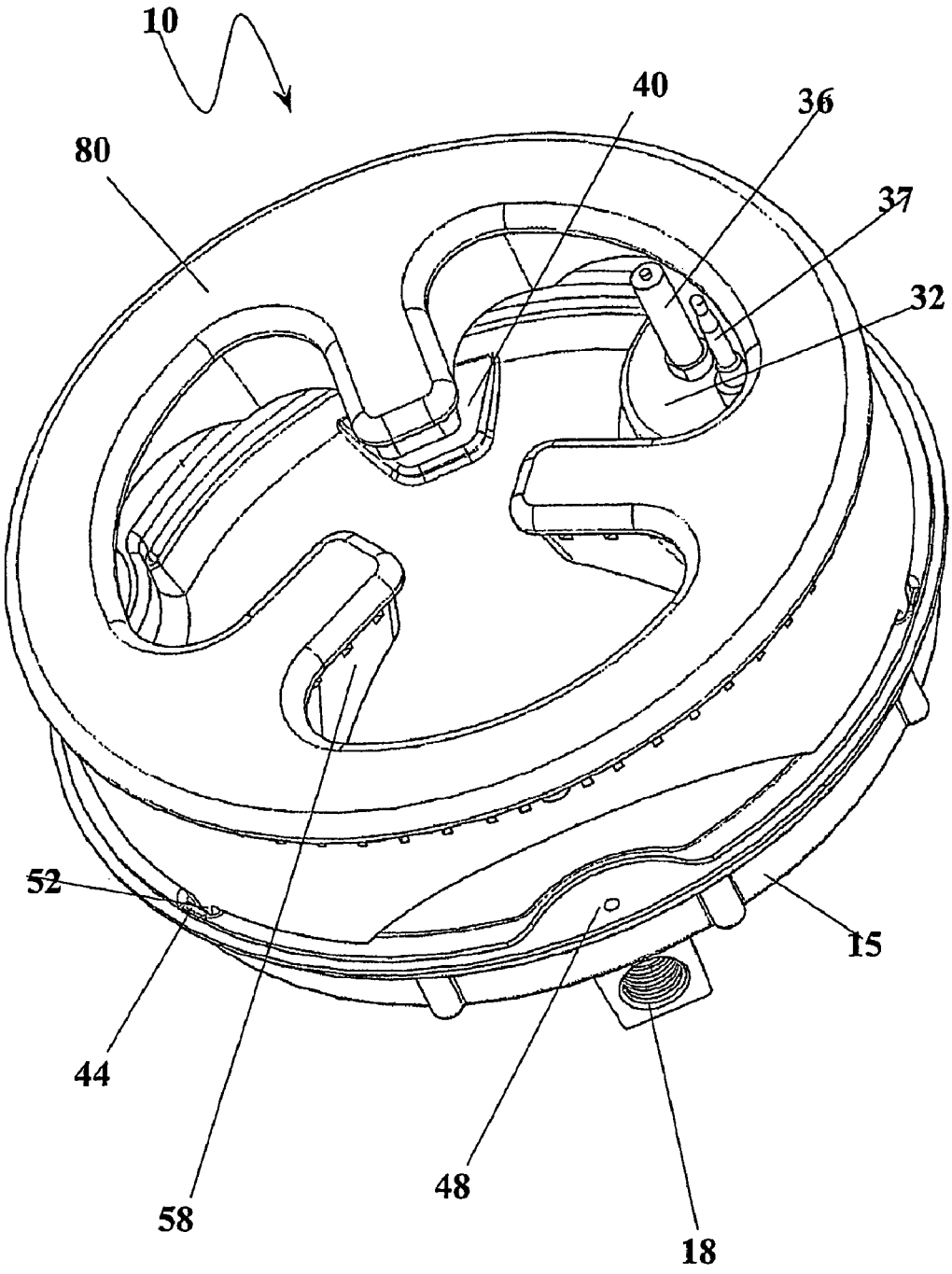
FIG. 1 is a perspective view of an assembled gas burner.
Figure 2:
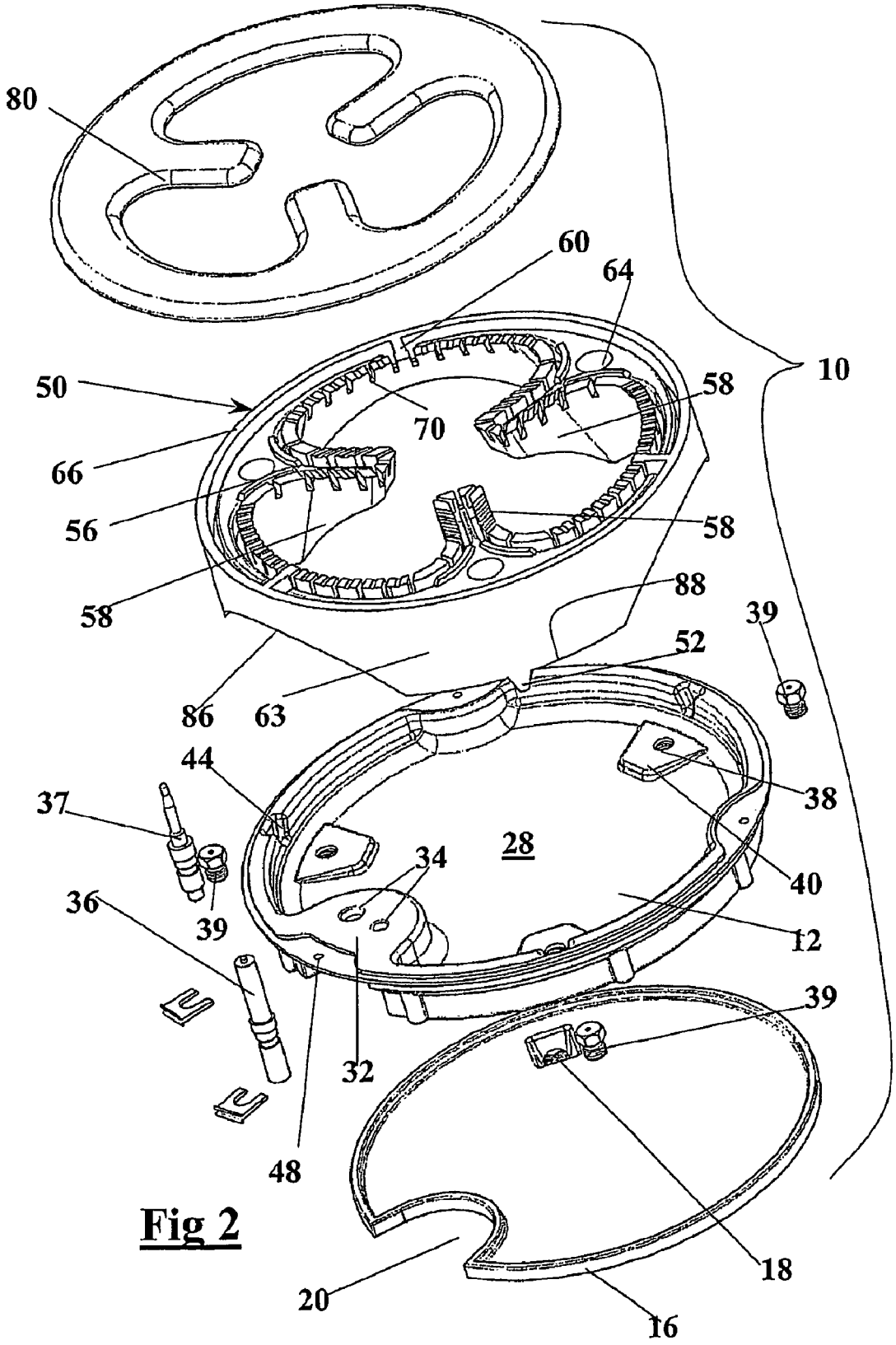
FIG. 2 is an exploded view of the burner of FIG. 1.
Figure 3:
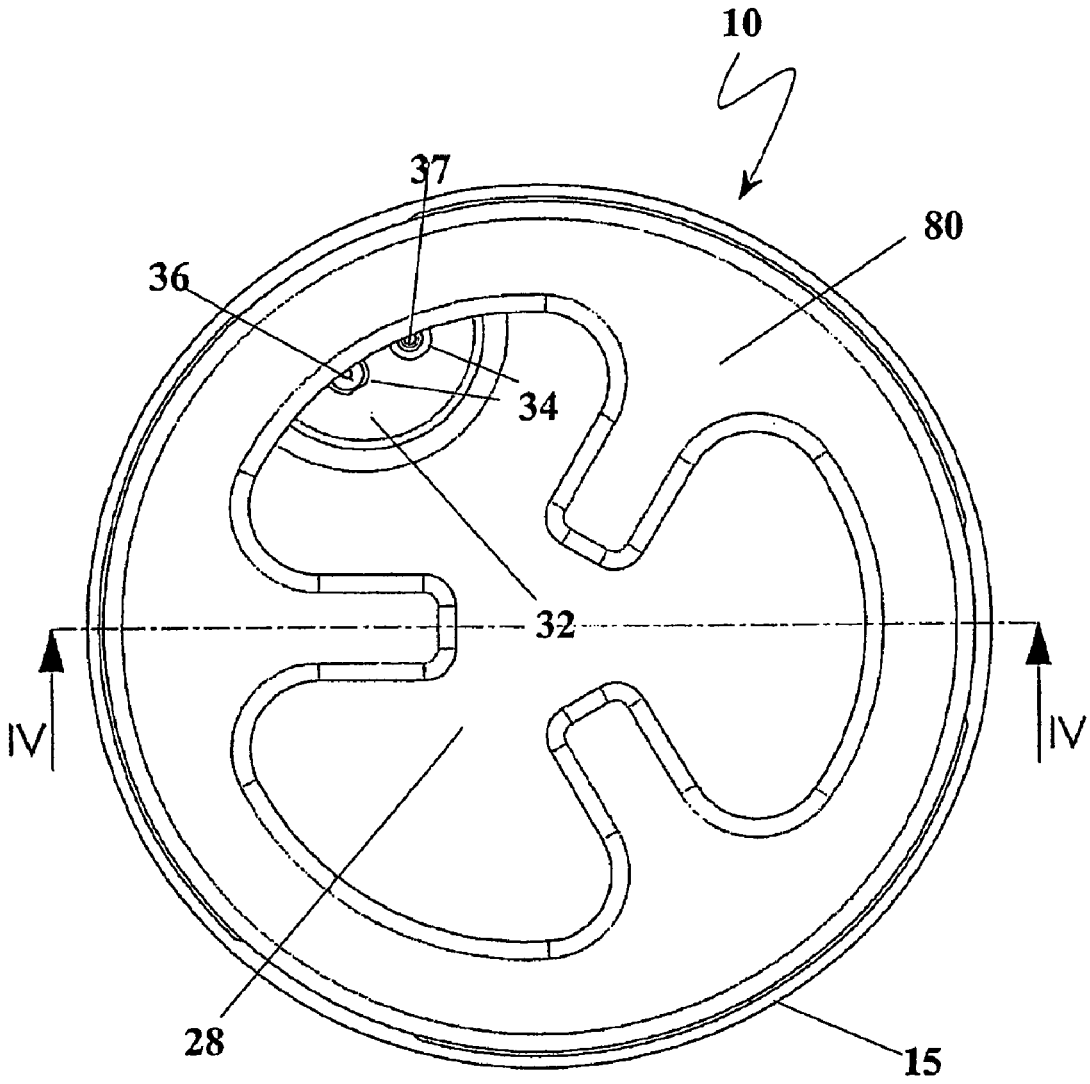
FIG. 3 is a plan view of the burner of FIG. 1.

Illustrated in FIGS. 1 to 7 is a burner 10 which is an assembly of several components including a manifold 15 which forms the base of the burner 10. The manifold 15 is an assembly of a manifold top member 14 and a manifold bottom member 16. The manifold top member 14 has its upper surface generally concave and thereby forms a cup 12. The manifold bottom member 16 has a threaded female gas supply connection 18 and a cut out portion 20 which receives the downwardly projecting side wall of the boss 32 on the base of manifold top member 14 to fit therein. The purpose of the boss 32 will be discussed below.

The nature of the manifold top member 14 and manifold bottom member 16 is that they can be manufactured from relatively thin sections making them relatively simple to manufacture by any one of several methods such as injection moulding, casting or pressing.

The manifold bottom member 16 has four downwardly extending supports 24 which rest against the upper surface of a stove base (not illustrated) or burner box to support the manifold 15 when mounted in a stove enclosure. Two of the supports 24 have locating lugs 25 extending downwardly therefrom, as each are to be inserted in similarly shaped apertures on a stove enclosure.

The manifold bottom member 16 is effectively a cover which sealingly sits within a similarly shaped recess 26 located within the lowermost rim 28 of the manifold top member 14. As can be seen from the cross sections of FIGS. 4 and 7, the manifold bottom member 16 is substantially horizontal or straight in its construction. This is contrasted with the central portion 28 of the manifold top member 14 which is convex or part spheroidal in shape relative to the generally horizontal or straight surfaces of the manifold bottom 16. As a result, the central portion 28 is closer to the manifold bottom member 16 at its centre compared with the periphery 30, where the spacing away from the manifold bottom member 16 is greater.

Figure 4:
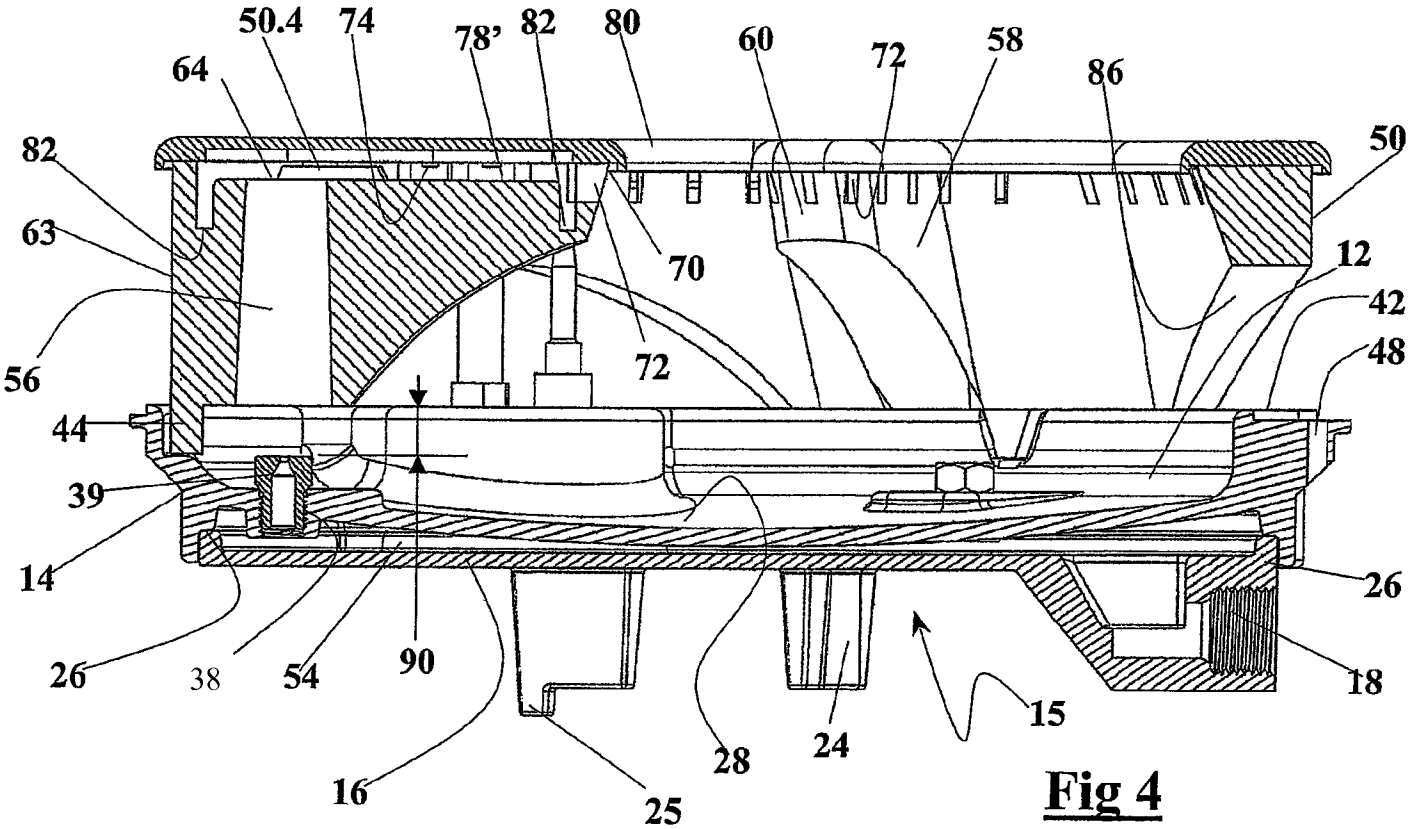
FIG. 4 is a cross section through the line IV-IV of FIG. 3.

The convex shape of the underneath surface of the manifold top member 14 (relative to the inside or cavity 54 of the manifold 15 as seen in FIG. 4) results in a passage of larger cross sectional area being formed around the outer periphery of the manifold 15 whilst a narrower or restrictive passage is provided through the central portions of the manifold 15. This provides a relatively easy formed path for gas flowing from the gas supply connection 18 to the nozzle apertures 38, which in most cases will flow around the manifold 15 circumferentially, but if necessary across the manifold through a convergent divergent path.

The cup 12 formed on the upper side of the manifold top member 14 also includes the boss 32 which is raised from the central portion 28. The boss 32 has its side wall extending downwardly, to form part of the rim which forms the recess 26. Two bores 34 pass through the boss 32. The bores 34 allow a spark plug 36 and a flame sensor 37 to be positioned therethrough. From underneath the manifold bottom member 16 appropriate control wiring (not illustrated) is connected to the flame sensor 37 and the spark plug 36 to generate a spark when a user desires to do so. The boss 32 ensures that the spark plug 36, flame sensor 37 and associated wiring does not pass through the cavity of the manifold 15.

Equi-spaced around the perimeter of the cup 12 or top surface of the manifold top member 14 are three nozzle apertures 38. The nozzle apertures 38 are threaded and each receive a male threaded injector nozzle 39. The injector nozzle 39 utilised will depend upon whether the burner 10 is utilised with town gas, natural gas or LPG.

Surrounding the nozzle apertures 38 are nozzle bosses 40. The purpose of the nozzle bosses 40 and the boss 32 is to protect the injector nozzles 39, the spark plug 36 and flame sensor 37 from any food or liquid spilt through the burner and onto the cup 12. The dish shape or concave nature of the upper surface of the central portion 28 of the cup 12 is such that any liquid or food upon hitting the surface will tend to be directed towards the centre of the cup 12 and thus away from the injector nozzles 39, spark plug 36 and flame sensor 37.

Around the upper rim 42 of the manifold top member 14 are three equi-spaced tapered notches 44 which will receive similarly shaped locators 52 extending downwardly from the lowermost rim 88 or skirt of the distributor 50. It will be noted that the notches 44 are on the same imaginary radius of the manifold top member 14 as the nozzle apertures 38 so that the nozzle aperture 38 and notches 44 are aligned.

The manifold bottom member 16 is attached to the manifold top member 14 by means of screws (not illustrated) spaced around the perimeter of the manifold bottom member 16. Any appropriate fixing system could be utilised such as riveting, clinching, bending the edge to form a retaining tag. If necessary, an appropriate sealant such as a gasket, or silicone rubber could be used to seal the two pieces of the manifold 15 together.

Also included in the upper rim 42 of manifold top member 14 are three mounting holes 48 which are used to secure the assembly of the manifold top member 14 and manifold bottom member 16 respectively into a stove enclosure (not illustrated).

Figure 5:
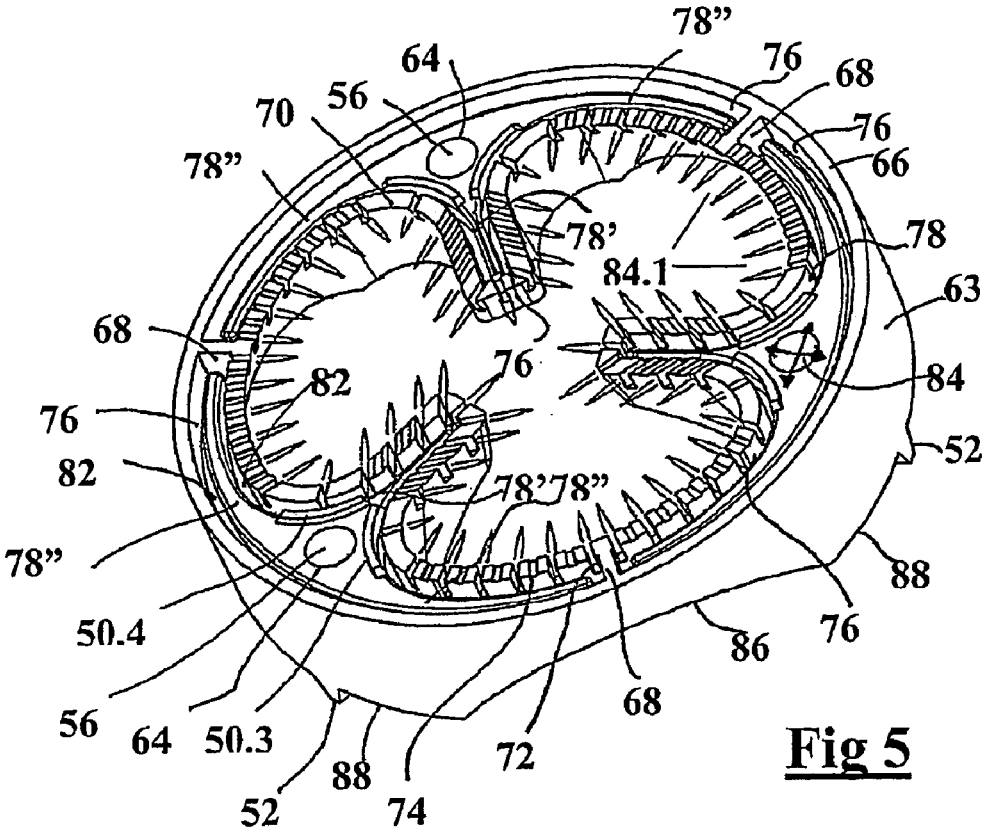
FIG. 5 is a perspective view of a distributor used with the burner of FIG. 1.
Figure 6:
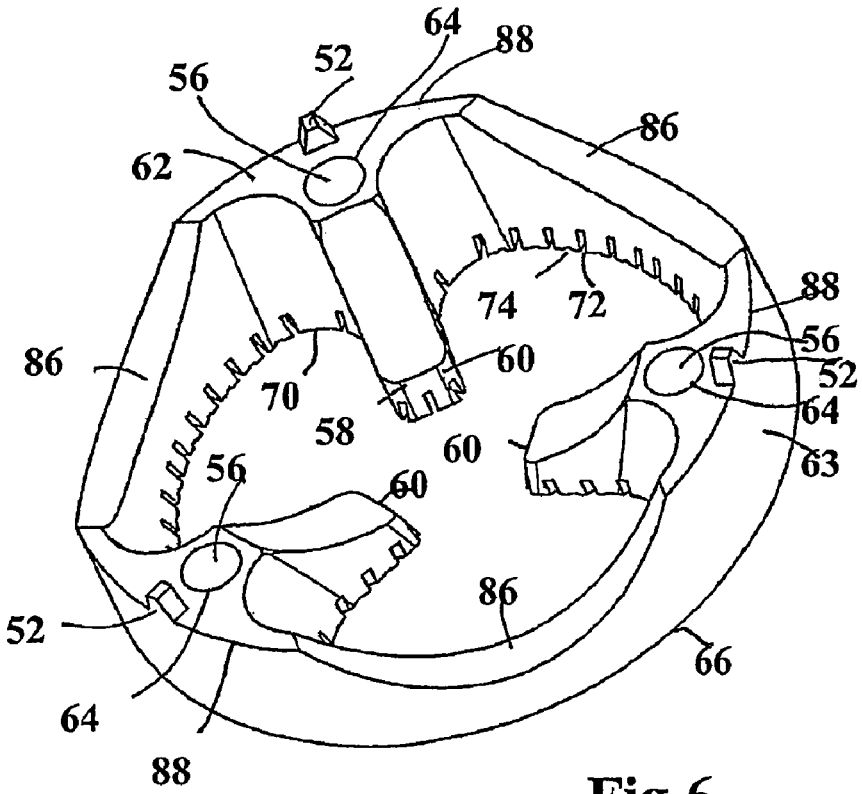
FIG. 6 is an underneath perspective view of the distributor of FIG. 5.

The distributor 50 is illustrated in more detail in FIGS. 5 and 6. The distributor 50 is made from aluminium or sintered steel and has a periphery which is circular and a generally cylindrical outer wall 63. The periphery has three equi-spaced downwardly extending tapered locators 52 that are on the same radius as a venturi passage in the form of a tapered bore 56. The tapered bore 56 makes up a portion of a venturi system provided in the distributor 50. The tapered bore 56 begins from a relatively flat face 62 and proceeds to a transition port 64 having a smaller diameter on an internal top surface of the distributor 50. The other portion of the venturi system is a generally horizontal venturi portion made up of venturi extensions 78' and 78", as will be described in more detail later. The transition port 64 is the port that is located in the venturi where the venturi is of minimum cross sectional area. The transition port 64 is also the location where the air gas mixture flow through the venturi changes from a generally vertical flow to a generally horizontal flow.

The distributor 50 is of a generally annular or ring shaped construction with three radially inwardly projecting arms 58 which are of a tapered construction. This tapered construction provides the arms 58 with a minimum depth at their extremities 60 which increases to a maximum depth at a location radially inward of the base and inboard of the tapered bore 56.

Between the termini 60 of the radially inwardly directed arms 58 there is provided an unobstructed space. This unobstructed space helps in the distribution of heat to the surface of a wok or other cooking utensil. Further, each of the radially inwardly extending arms 58 has a portion which consists of essentially parallel sides.

The upper rim 66 of the generally cylindrical outer wall 63 terminates in a single plane and completely surrounds the upper end of the distributor 50. At three equi-spaced locations (these locations being circumferentially equidistant from the outlet ports 64), are located segment-separating walls 68 which also terminate in the same plane as the rim 66. The walls 68 interconnect rim 66 with the inner wall 70, the upper edge of which reaches the same plane as the wall 68 and rim 66. The inner wall 70, by virtue of the radial arms 58 forms a clover-leaf shaped aperture through the distributor 50.

Through the inner wall 70 are a series of flame ports 72 of which only one has been numbered in FIG. 5, to maintain clarity of the drawing. The flame ports 72 give the inner wall 70 a castellated appearance. It will be noted that on the inner wall 70 between any two adjacent flame ports 72 is another much shallower flame retention slot 74. The flame retention slot 74 helps to maintain a flame on the flame ports 72 when the distributor is in operation.

The tops of inner wall 70, between walls 68 and the interconnecting portion of the rim 66, being all in the same plane all make contact with a steel cap 80 positioned onto the top of the distributor 50. As is illustrated in the cross section of FIG. 4 or 7, the top of the inner wall 70, segment wall 68 and rim 66 will make contact with the undersurface of the cap 80 and will thereby form a series of flame ports 72.

As is illustrated in FIG. 5 the longitudinal direction of the flame ports 72 will result, for each segment of the distributor 50, in a flame 84.1, which will form a flame pattern which is schematically depicted in FIG. 5. It will be noted that all the flame ports on the internal periphery of the distributor 50 result in flames having a directional component which is directed internally of the distributor, but offset from the centre of the distributor 50.

It will be noted from FIG. 5 that the flame ports 72 and for that matter the flame retention ports 74 which are located on arms 58, are shown as being directed towards the centre of the distributor 50. One means for achieving this is for the ports 72 and 74 to be structured so that the axis of the passage forming the port lies at an acute angle to the radial direction of extension of the arm 58. By this means a direction component of the flame will be generally parallel to the direction of radial extension of the arm 58 and further will be directed internally of the distributor, albeit parallel to a radius from the geometrical centre of the distributor 50.

Along a portion of the edge of the venturi extensions 78', 78", at the interface between the circumferentially extending venturi extensions 78" and the radially inwardly extending venturi extension 78', there is provided two occluding ridges 50.4 and 50.3. The function of these ridges will be explained in more detail below, with reference to FIG. 11.

As can be seen from FIG. 5 each burner segment, at a location adjacent the rim 66, inner wall 70 and segment walls 68, has a channel 76. The channel 76 makes a circuit around the periphery of the burner segment. It can be seen from FIG. 5 that a crescent crossed T shaped arrangement is formed from the venturi extensions 78' and 78", whose vertical walls form the inner wall of the peripheral channel 76.

Figure 7:
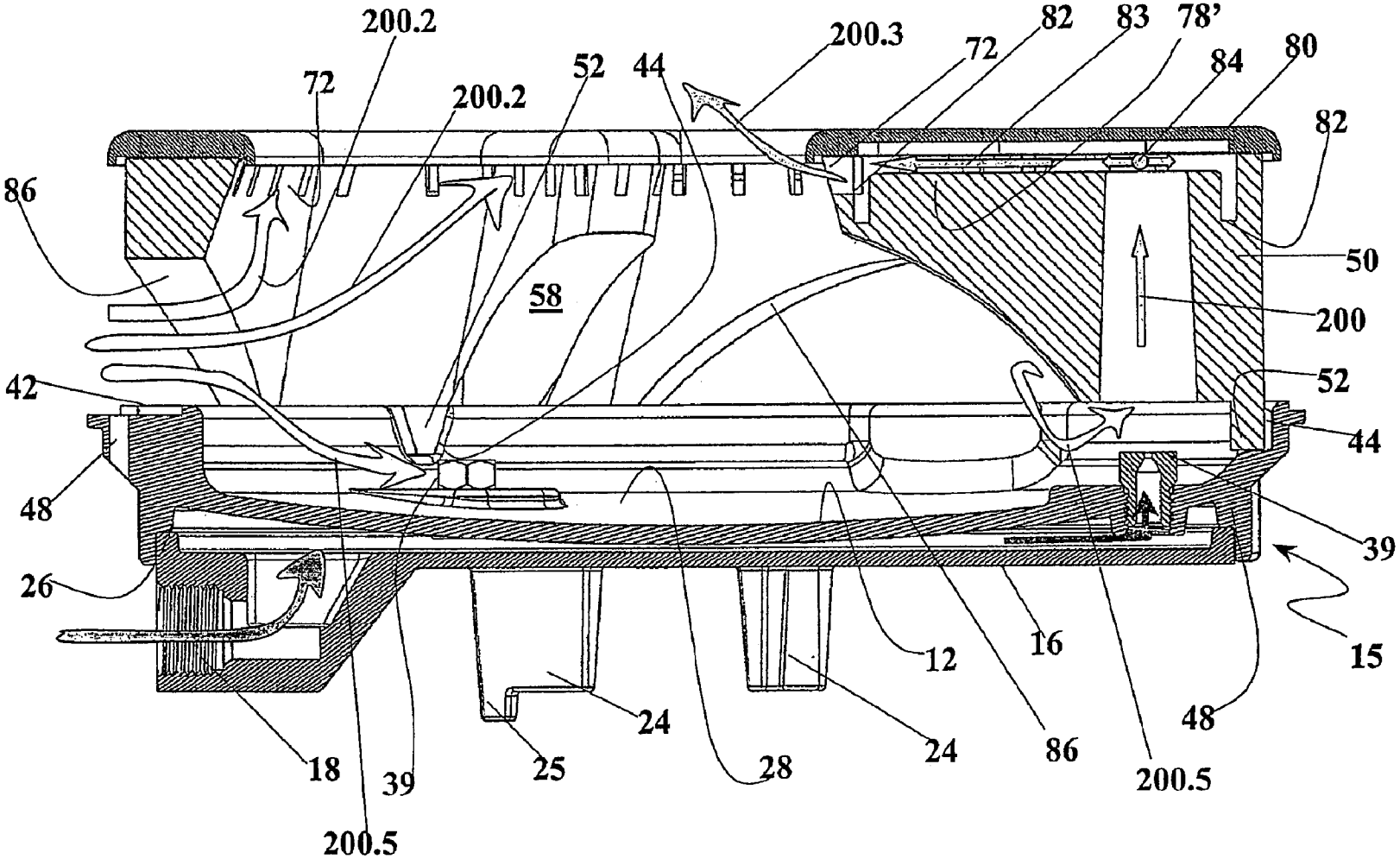
FIG. 7 is a larger scale cross section (similar to FIG. 4) of the assembled burner of FIG. 1, showing air, gas and air/gas mixture flow paths.

It will be noted from the cross section of FIG. 4 that the venturi extensions 78' and 78" terminate at a level or height above the channel base 82 which is below the plane containing the termination of the rim 66, walls 68 or inner wall 70. This construction means that any gas passing out of the manifold 15 via the nozzle apertures 38 and the injector nozzles 39, will travel upwardly through the tapered bore 56 and whilst doing so will entrain primary air (see arrows 200 as illustrated in FIG. 7). The air gas mixture will pass out of the transition port 64 and travel in the generally horizontal directions of arrow 83 in FIG. 7, the crossed arrows 84 of FIG. 5, and the arrow 84 into and out of the page of the drawing along the circumferentially extending venturi extension 78" in FIG. 7, thereby pressurising the channel 76 with an air gas mixture. The upper horizontal surface of the venturi extensions 78' and 78" act as a horizontal venturi which assists with the uptake of primary air.

The venturi extensions 78' and 78" extend in three directions away from the transition port 64. The venturi extensions 78" extend in two circumferential directions which are generally opposite to each other and concentric to the rim 66, while the third venturi extension 78' extends in a radially inward direction along the radially inwardly directed arms 58.

As can be seen from FIG. 7, the gas represented by arrows 200.1 enters through the female connector 18. This gas passes through manifold 15 and when ejected from injector 39 will entrain the primary air represented by arrows 200.5 (from the side edges of the air inlet ports 86) to form an air gas mixture 200 which is used for combustion (see dotted arrows 200.3) at the flame ports 72 as illustrated in FIG. 4.

Once one flame port 72 has the exiting air gas mixture ignited by means of the spark plug 36, all the rest of the flame ports 72 will catch alight and a flame pattern as schematically depicted in FIG. 5 will result.

The lower rim of the distributor 50 has three equi-spaced air inlet ports 86 which have the centre aligned with the segment walls 68. The air inlet ports 86 allow secondary air represented by arrows 200.2 to pass from outside to the inside of the distributor 50 and thus be entrained and combusted with the air gas mixture.

Each air inlet port 86 is of a generally diverging then converging shape when viewed in the circumferential direction around the outside of the distributor 50. This diverging then converging shape means that the centre portion of the air inlet port 86 is of a greater cross sectional area than the extremities and is located so as to be immediately below and outboard of the circumferentially located flame ports 72, the flame ports 72 being located along the left and right sides of consecutive radially inwardly extending arms 58. Thus through the main or central cross sectional area of the air inlet port 86, the bulk of air flowing through the air inlet port can be used as secondary air for the burner, whereas at the reduced cross sectional area sections at the left and right extremities of the air inlet port 86, the air passing through these portions will travel circumferentially (see arrows 200.5 of FIG. 7) once within the confines of the distributor 50 and thus travel to the injector 39 to be entrained as primary air in the venturi passage or tapered bore 56.

The distributor 50 has its lowermost rim 88 between the air inlet ports 86 in contact with the upper rim 42 of the manifold 15, thereby generally preventing air passing directly underneath the rim 88 and into the injector 39. This feature prevents any drafts from adversely influencing the injector and its operation in entraining primary air and mixing same with gas.

It will be noted that there is one air inlet port 86 for each injector 39 and that between the left and right extremities of adjacent air inlet ports 86, in approximately the centre thereof, is located the injector 39 which is also positioned by the inboard side of wall 63 of the distributor 50.

While the air inlet ports 86 in the FIGS. 1 to 7 are illustrated as circular segments, other shapes could be utilised including eye-shaped, diamond shaped, triangular, half eye-shapes or half diamond shapes. These could be provided as cut-outs or as a hole with a complete rim through the wall 63 of the distributor 60.

The distributor 50 rests on the cup 12 or manifold 15 by means of the locators 52 being positioned within the shaped notches 44. This will align the tapered bores 56 and outlet ports 64 over the nozzle apertures 38 and associated injector nozzles (not illustrated). Having three equi-spaced locators 52, will ensure the alignment of these features in any of the three possible orientations of the distributor 50 on the cup 12. The size, shape and length of the locators 52 and notches 44 must be matched so as to ensure that the rim 88 makes contact with the manifold periphery 42, thus preventing air flow underneath rim 88.

The lowermost rim 88 on either side of the locators 52 (the lowermost rim being the edge of the surface 62 of FIG. 6) will rest against the upper rim 42 of the manifold upper member 14. As can be seen from the cross sections of FIG. 4, a gap indicated by the distance 90 in FIG. 4 will be located between the flat surface 62 and the upper surface of the nozzle bosses 40. This gap will allow air to be entrained by gas flowing from the injector nozzles 39 when the burner is assembled and connected to a supply of gas.

The manifold 15 can be manufactured from aluminium and an appropriate gas tight seal provided between the manifold bottom member 16 and the manifold top member 14. For cleaning purposes there is no securing of the distributor 50 onto the manifold 15 and the cap 80 is not secured to the distributor 50 for the same reason.

While wall 68 is provided to segment the distributor 50, it is expected that such a segment wall 68 could be removed. If the wall 68 were not present, and assuming the influence of equal gas pressure emanating from the injectors nozzles via transition port 64 and over the venturi extensions 78' and 78", it is envisaged that the flow of gas will functionally segment the distributor 50 with similar effect as currently results by means of the segmented wall 68.

If desired the number of radially inward arms 58 can be reduced to two or increased to four, five or six depending upon the outside diameter of the distributor 50.

Figure 8:
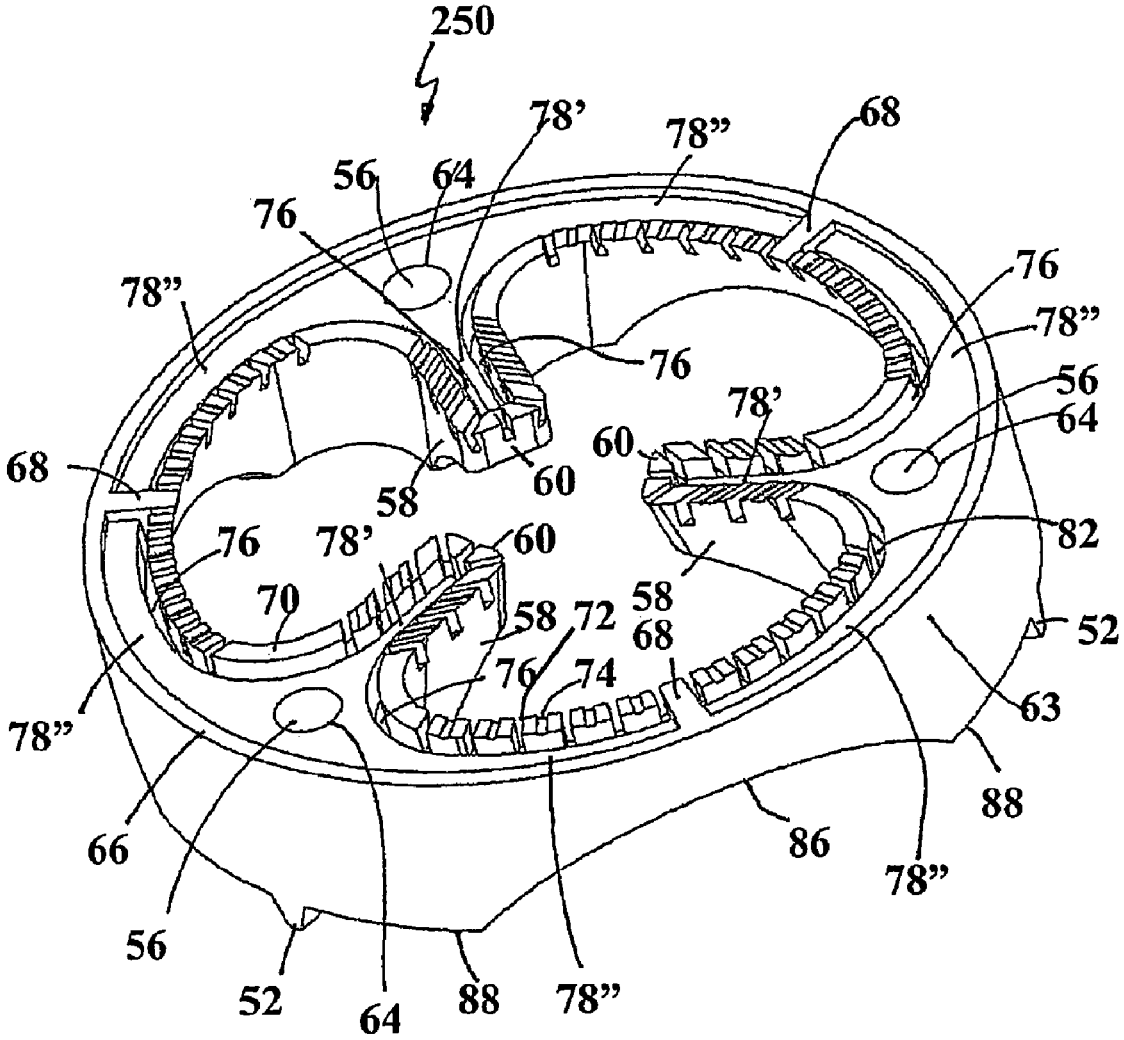
FIG. 8 is a perspective view of another distributor similar to that of FIG. 5.

Illustrated in FIG. 8 is a modified distributor 250, which is similar to the distributor 50, with like features being like numbered. The difference between the distributor 250 and the distributor 50 is that the portion of the channel 76 which runs adjacent to the rim 66 is absent in the distributor 250, and thus the channel 76 is only adjacent the inner wall 70 in the distributor 250. Another difference is that occluding ridges 50.4 and 50.3 are not utilised.

Figure 9:
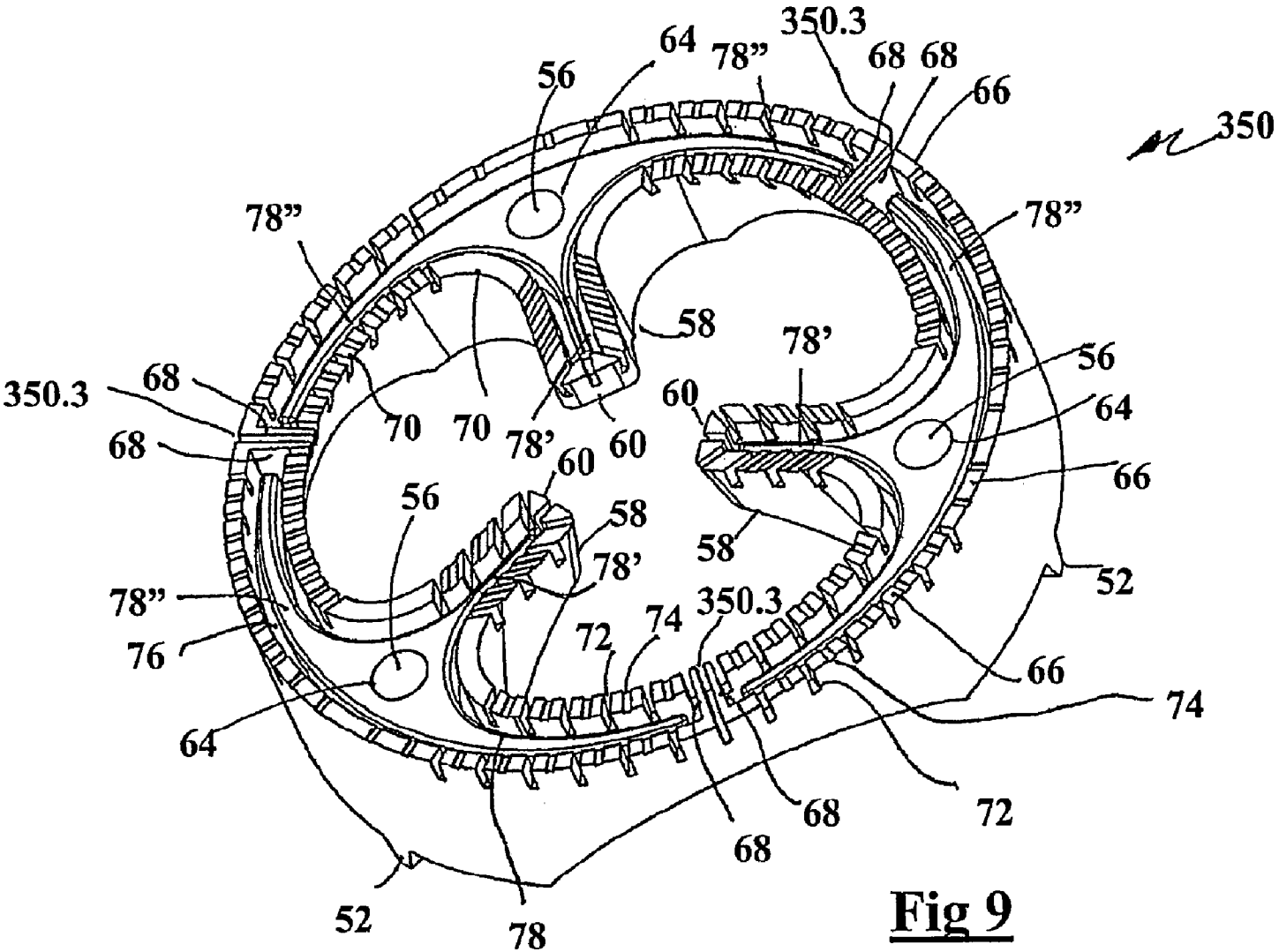
FIG. 9 is a perspective view of another distributor, similar to that of FIG. 5 with outer circumferential burner ports.

Illustrated in FIG. 9 is a modified distributor 350 which is similar to the distributor 50, and accordingly, like parts have been like numbered. The difference between the distributor 350 and the distributor 50 is that the distributor 350 has radially outwardly directed flame ports 72 and retention ports 74 in the outer circumference or rim 66. The ports 72 and 74 through rim 66 are approximately the same size as the ports 72 and 74 on the internal perimeter of the distributor 350. Ports 72 and 74 through rim 66 help to increase the thermal output of the assembled burner.

Another difference is that there are separate walls 68 forming the terminus of each segment. Between the adjacent walls 68 is a cross lighting passage 350.3. The purpose of the passage 350.3 is to allow cross lighting or flame propagation from inside the burner to the ports 72 and 74 through rim 66 when the inwardly directed ports are ignited.

A further difference is the lack of occluding ridges 50.4 and 50.3 which are present on the distributor 50. The distributor 50, whilst having flame ports 72 through the rims 66, does not have any flame ports in the region immediately above locator 52 and radially outwardly from the arm 58. What is present however are flame retention ports 74. This allows a trivet to be utilised with the burner and prevents heat being wasted, as well as ensuring lighting of the ports 72 when the burner has been turned down.

Illustrated in FIG. 10 is a distributor 450 which is similar to the distributor 350 of FIG. 9. Like parts have been like numbered. The distributor 450 has some improvements when compared to the distributor 350.

A first improvement is a broader flame propagating or cross lighting channel 350.3 which has been provided with facing flame retention ports 450.1. Each flame retention port 450.1 is located through a respective segment-separating wall 68 at the ends of each segment. The flame retention ports 450.1 help to maintain a flame in this area thus allowing flame to propagate from the flame ports on the internal periphery of the distributor 450 to the flame ports on the external periphery.

Another point of difference is in the region of the venturi around the tapered bores 56 and the associated outlets 64. This is shown in more detail in FIG. 11. From FIG. 10 it can be seen that the venturi extensions 78' extend radially inwardly to the same degree as in the distributor 350, but the distributor 450 has the circumferentially extending venturi extensions 78" being curtailed and tapering off to the bottom 82 of the distribution chamber. It will also be noted that in the distributor 450 the depth of the channels 76 between the circumferentially extending venturi extensions 78" and the inboard surface of the rim 66, and between the radially extending venturi extensions 78' and the inboard surface of the inner wall 70, are of reduced in depth by comparison to the previously described distributors.

It has been found that the shortening of the circumferentially extending venturi extensions 78" helps to balance the pressure of the air gas mixture within the distribution chamber and provide a balanced flow of air gas mixture through all ports. This helps to provide better control of the flames and thus the heat output.

Illustrated in FIG. 11, near a portion of the edge of the venturi extensions 78" and 78" are three occluding formations being an outer located occluding ridge 450.2 and two similarly sized and shaped inwardly occluding ridges 450.3 and 450.4. It will be seen from FIG. 11 that the occluding ridges are higher towards their centre and taper towards their extremities. The occluding ridges 450.2, 450.3 and 450.4 serve two functions. The first function is to direct the air gas mixture exiting from the transition port 64 over the upper surfaces of the venturi extensions 78' and 78" in the two circumferential, and one radial, directions of extension. A second function is to prevent an undesired amount of air gas mixture escaping through the five flame retention ports 74 on the external wall 66 which is achieved by the occluding ridge 450.2 as well as out of the flame retention ports 74 on the opposing internal peripheral walls 70 by means of the occluding ridges 450.3 and 450.4.

It will also be noted from FIGS. 10 and 11 that the transition port 64 at the end of the tapered bore 56 is provided with a radius or bevel 64.1. It is expected that in some circumstances this radius or bevel might improve flow of air gas mixture out of the tapered bore 56 and into the horizontal portions of the venturi.

Illustrated in FIG. 12 is a burner 500 which is similar in construction to previously described burners and has a distributor 550 which is similar in construction to the distributor 450. The distributor 550 differs from the distributor 450 in that the inwardly extending arms 58 also extend upwardly at an angle of inclination of approximately 15° to 30° above the horizontal.

Similarly in regards to FIGS. 14 and 15, a burner 600 has a distributor 650, which is similar to the distributor 550 of the burner 500, except that the inwardly extending arms 58 lie at an angle of declination of between 15° to 30° below the horizontal. In respect of both the burners 500 and 600, advantages such as angling of the trivets used with the burner might provide greater efficiency in heating of a wok or similar cooking utensil.

Illustrated in FIGS. 16 and 17 is a burner and trivet combination which can be assembled onto a hob. The trivet 700 is made up of three similarly shaped support arms 702 which have inclined upper surfaces 704 for supporting a wok or other cooking utensil.

It will be noted from the plan view of FIG. 16 that the trivet arms 702 are arranged so as to overlie the centre lines of the radially extending arms 58. Further, as the trivet arm 702 passes over the external wall 66 of the distributor 450 the leg 706 of the trivet arm 702 is adjacent that portion of the external of the burner which is not provided with flame ports 72 but rather only has flame retention ports 74—see FIG. 11. By this arrangement the amount of heat transferred to the trivet 700 will be kept as low as possible thus making as much heat energy available to heat the cooking utensil as is possible.

Figure 18:
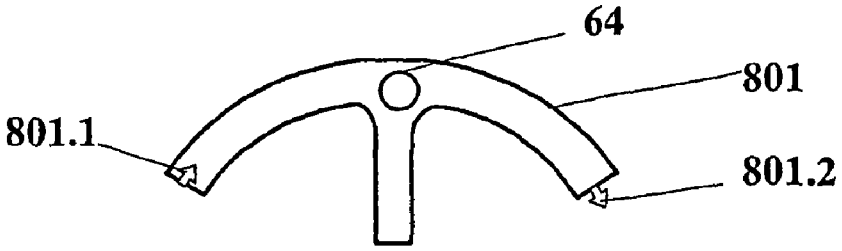
FIG. 18 illustrates a schematic of a burner segment of the burners illustrated in the previous Figures.

Illustrated in FIG. 18 is a schematic representation of a burner segment 801 such as is utilised in the previous described distributors and burners. The segment has three arms, two being circumferentially extending from the transition port 64 in opposite directions and the third being centrally located and extending radially away from the transition port 64.

Figure 19:
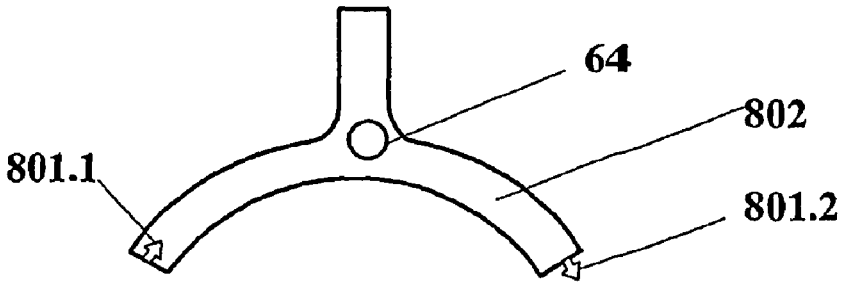
FIG. 19 illustrates a schematic of another burner segment.

Illustrated in FIG. 19 is another burner segment 802 whereby the segment 802 extends in three directions, two circumferentially and in opposite directions with the third in a radially outward direction from the centre located transition port 64. The segment 802 also includes formations 801.1 and 801.2

Figure 20:
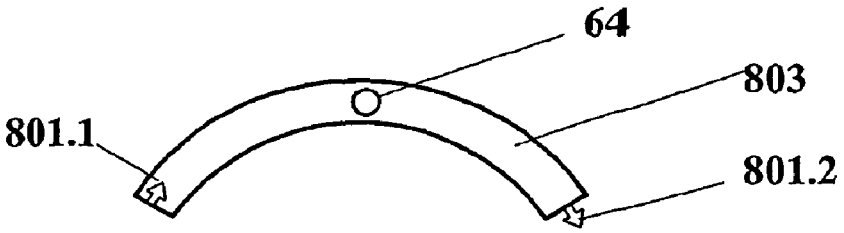
FIG. 20 illustrates a schematic of a further burner segment.

Illustrated in FIG. 20 is a burner segment 803, where extension away from the transition port 64 is only in two opposite circumferential directions. The segment 803 also includes formations 801.1 and 801.2

Figure 21:
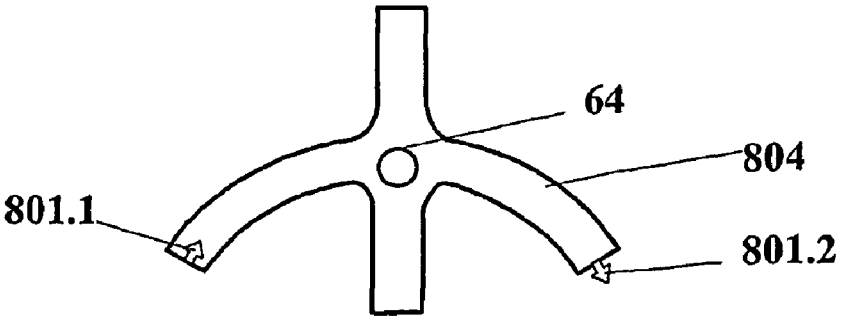
FIG. 21 illustrates a schematic of another burner segment.

Illustrated in FIG. 21, a segment 804 extends away from transition port 64 in four generally opposite directions, being two circumferential directions and two in opposite radial directions. The segment 804 also includes formations 801.1 and 801.2

The shapes of the burner segments 801, 802, 803 and 804 illustrated in FIGS. 18 through to 21 can broadly be described as, in the case of FIG. 18: a T shape with a concave arcuate or circumferential cross bar; in the case of FIG. 19: T shape with a convex arcuate or circumferential cross bar; in the case of FIG. 20: an arcuate shape; or in the case of FIG. 21: a cross shape with an arcuate or circumferential cross bar.

While the description above in relation to FIGS. 1 to 17 describes that the segments of the distributors are integrally formed in a single piece distributor, if desired, the segments can be provided with interlocking or other joining mechanisms, whereby adjacent burner segments can be joined together according to the duty of the assembled distributor and burner.

Accordingly, schematically represented in FIGS. 18 to 21 are interlocking formations 801.1 and 801.2 at the ends of the circumferentially extending portions of the respective segments. The formations 801.1 and 801.2 allow the respective segments to be assembled with three other segments, to form a complete distributor.

The interlocking formation 801.1 is an arrow shaped recess formed in the bottom of the segments 801, 802, 803 and 804 and is sized and shaped so as to receive the matching shaped, formation 801.2 which is an arrow shaped protrusion extending away from the segments 801, 802, 803 and 804 on an adjacent segment. While arrow shaped formation 801.1 and

801.2 are illustrated, other joining mechanisms could be used such as bayonet fittings, hook formations, spigots and apertures, locked together by circlips, etc.

If desired, either in combination with interlocking formations 801.1 and 801.2, or as an alternative to them, the discrete segments of the distributor can be held together by interaction with, or by contact with a burner cap, such as cap 80 of previous figures. Further if desired or as an alternative to this, the discrete segments could be held together by means of a circumferential strap or other circumferential binding system.

The burner segment 801, 802, 803 and 804 of FIGS. 18 to 21, can be combined, mixed and matched with same shape or different shape segments, so as to provide a generally circular ring of flame with inward and or outward radial extensions to help generate further heat.

As will be readily understood from FIGS. 19, 20 and 21 the venturi systems associated with these segments would have two, three or four venturi extensions 78' and 78" extending away from the transition port 64, so that the horizontal venturi portions can direct air gas mixture in the direction of the ends of the segments.

The above description show distributors made up of three segments which are separated by segment walls 68, and having three inwardly extending arms 58, and each segment has its own distribution channel and or chamber, injector and venturi associated therewith. However it will be readily understood that any number of segments and inwardly extending arms could be utilised, as is appropriate for the duty of the burner.

It is to be noted that if a segment has two, three or four extending sections that the horizontal venturi has a corresponding number of venturi extensions 78' and 78".

In the above described burners and distributors, the venturi extensions 78' and 78" are illustrated as being formed as part of the distributor. Further, as is illustrated in FIGS. 10 and 11, the occlusion ridges 450.2, 450.3 and 450.4 are also shown depending from the distributor. Finally, the flame ports 72 and flame retention ports 74 are shown as being formed in the distributor. If desired, each of these features could be formed in the base of a cap which will sit on top of the distributor or alternatively could be formed by a combination of being formed on the underside of the cap and on the distributor.

Figure 22:
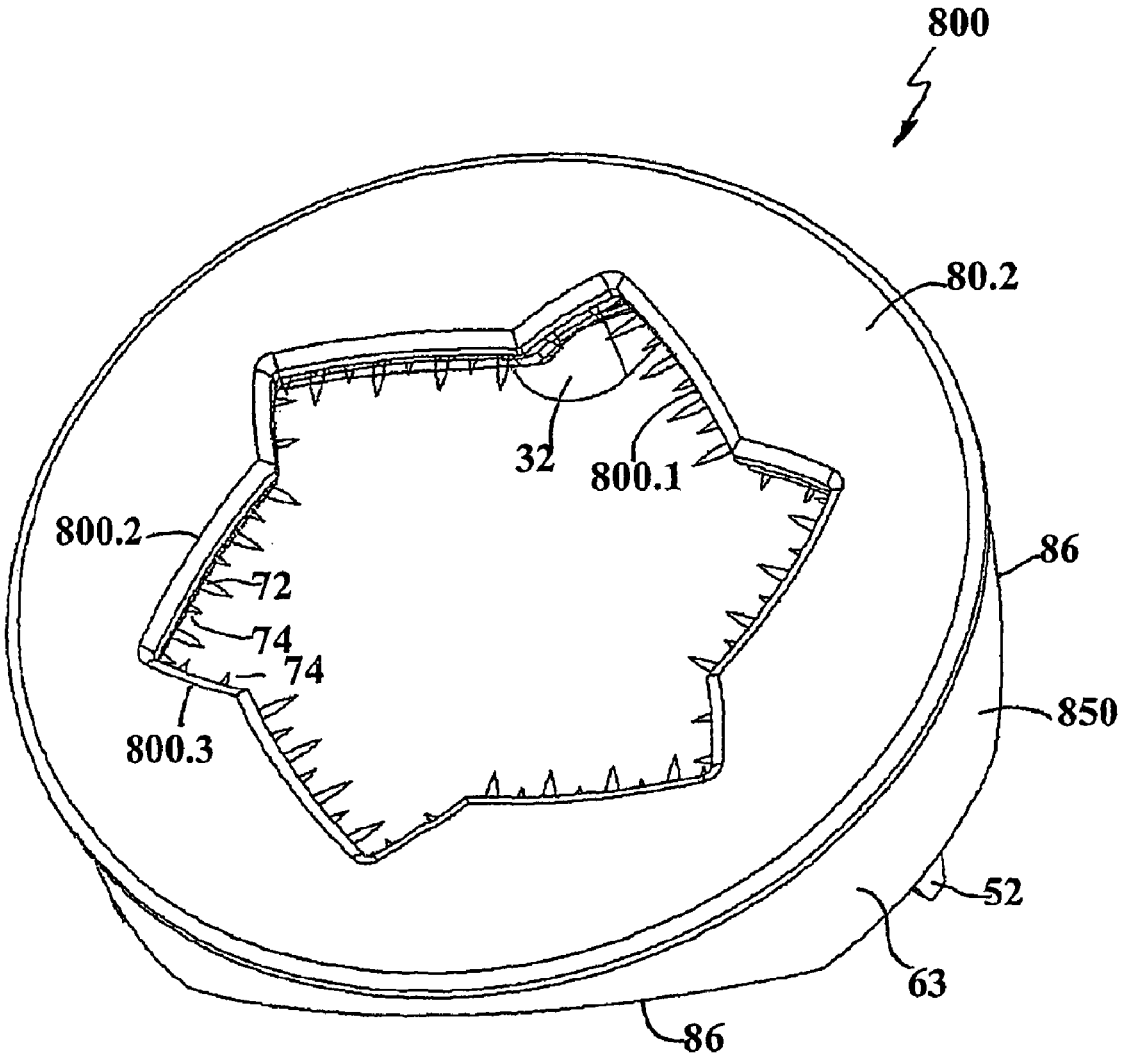
FIG. 22 illustrates a burner having a distributor which will allow a spiral or helical flame effect to be produced when the burner is in operation.

Illustrated in FIG. 22 is a burner 800, which includes a distributor 850 and a correspondingly shaped cap 80.2, which differ from the previously described burners by a star shaped aperture 800.1 being provided instead of the clover leaf shaped aperture of other embodiments. The star shaped aperture 800.1 is comprised of long sides 800.2 and short sides 800.3. The long sides 800.2 have a combination of flame ports 72 and retention ports 74, whereas the short sides 800.3 have only flame retention ports 74 therein. By directing the main flames from flame ports 72 in an anti clockwise direction a spiral flame pattern will result due to the buoyancy of the flame and its propulsion in an anti-clockwise direction. Like previous embodiments the flame port 72 are directed towards the centre of the burner.

The burner 800 has the segmented distributor, a similar venturi and venturi extension arrangement structure as in previous embodiments. While flame ports are shown on the internal periphery of the burner 800, externally mounted flame ports could also be provided.

To assist this further in the spiral flame effect, the flame ports 72 can also have their axis orientated at an angle of inclination above the horizontal.

Figure 23:
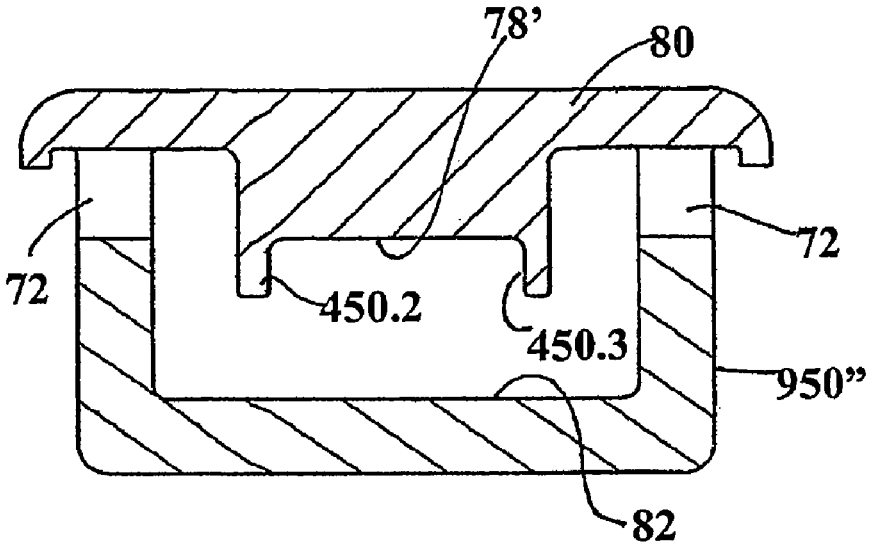
FIG. 23 illustrates a cross section through a burner showing flame ports, venturi extensions and occlusion ridges formed in the underside of a burner cap.

Illustrated in FIG. 23 is a cross section through a portion an arm 58 of a burner wherein flame ports 72, venturi extensions 78' and occlusion ridges 450.2 and 450.3 are all formed as part of a cap 80. The distributor 950 has a crescent crossed T shape distributor channel, which across its width and length has full depth down to the base 82 of the chamber. The distributor 950 also includes a vertical venturi passage 56 with the corresponding transition port 64.

Figure 24:
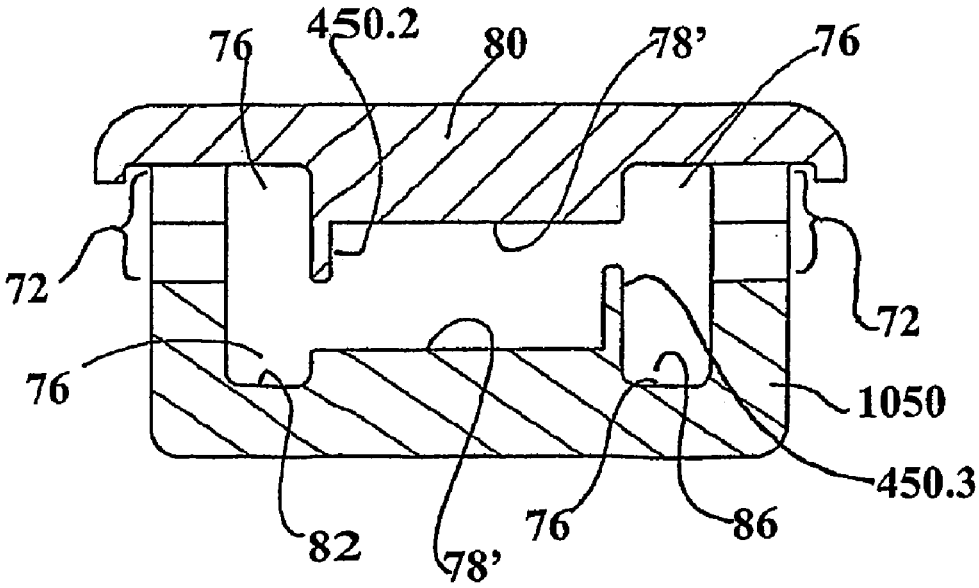
FIG. 24 illustrates a cross section through a burner showing flame ports, venturi extensions and occlusion ridges formed in a combination of a distributor and a burner cap.

Illustrated in FIG. 24 is a cross section through a portion of an arm 58 of a burner wherein flame ports 72, venturi extensions 78' and occlusion ridges, 450.2 and 450.3 are formed by a combination of formations on the underside of the cap 80 and in the distributor 1050. The top half of the flame port 72 being formed on the cap 80, while the bottom half is formed on the distributor 1050. In FIG. 24 one occlusion ridge 450.3 is formed on the cap 80 while the other occlusion ridge 450.3 is formed on the distributor 105. A top half of a venturi extension 78' is formed on the cap 80, while the bottom half is formed on the distributor 1050. If desired the occlusion ridges 450.2 and 450.3 could both extend from the distributor or both from the cap, or half from distributor and half from cap.

It will be understood that the invention disclosed and defined herein extends to alternative combinations of two or more of the individual features mentioned or evident from the text or drawings. All of these different combinations constitute various alternative aspects of the invention.

The foregoing describes embodiments of the present invention and modifications, obvious to those skilled in the art, can be made thereto without departing from the scope of the present invention.

The invention claimed is:

1. A gas burner including:

a distributor means having at least three distribution chambers to distribute an air gas mixture around said distributor, each distribution chamber consisting of three distribution channels having a substantially "T" configuration;

each distribution channel including a plurality of flame ports through which said gas mixture can pass and be ignited;

at least one injector associated with each of said distribution chambers to deliver gas to the distribution channels;

each of the injectors being positioned to inject gas into its associated distribution chamber via a an associated venturi system including an upwardly directed passage and a transition port and wherein the distribution channels enable gas flow in at least three directions away from said transition port and towards associated flame ports, wherein the burner has an internal aperture, at least some of the flame ports being oriented towards the internal aperture, each distribution chamber including at least one transversely projecting distribution channel which projects into the aperture, the transversely projecting channel including flame ports adapted to direct combustion gasses into the aperture.

2. A burner as claimed in claim 1, wherein two of the distribution channels of each distribution chamber extend circumferentially.

3. A burner as claimed in claim 1, wherein each venturi system includes an upright inward tapering section in fluid communication with a transverse expanding section via the transition port, the transverse expanding section being within the corresponding distribution chamber.

4. A gas burner as claimed in claim 1, wherein each distribution chamber includes a transversely extending distribution channel.

5. A burner as claimed in claim 1, wherein said distributor means has a generally cylindrical outer surface.

6. A burner as claimed in claim 1, wherein each distribution chamber has an inwardly extending distribution channel, the inwardly extending distribution channels including associated flame ports and being circumferentially equi-spaced.

7. A burner as claimed in claim 1 wherein each distribution chamber includes at least one outwardly extending arm.

8. A burner as claimed in claim 1, wherein the aperture has a clover leaf configuration.

9. A burner as claimed in claim 1 wherein said distributor means is segmented, whereby each segment has its own distribution chamber and injector.

10. A burner as claimed in claim 9 wherein said distributor means is segmented by means of segment walls between respective segments.

11. A burner as claimed in claim 9 wherein said distributor means is segmented by means of gas flow from said injectors.

12. A burner as claimed in claim 9 wherein said segments form one of the following: a cross shape with an arcuate or circumferential cross bar; a T shape with a convex arcuate or circumferential cross bar; a T shape with a concave arcuate or circumferential cross bar.

13. A burner as claimed in claim 1 wherein the air gas distribution channels of each distribution chamber form a T shape with an arcuate or circumferential cross bar.

14. A burner as claimed in claim 9, wherein each segment includes four air gas distribution channels which form a cross shape with an arcuate or circumferential cross bar.

15. A burner as claimed in claim 1, wherein said burner includes a cap which is positioned on top of said distributor means.

16. A burner as claimed in claim 15, wherein each distribution chamber includes a venturi extension formed at least partially in the cap.

17. A burner as claimed in claim 1, wherein said flame ports are formed in one or more walls of said distributor means.

18. A burner as claimed in claim 15, wherein said flame ports are formed in the cap.

19. A burner as claimed in claim 18, wherein each distribution channel has one or more occluding structures associated therewith for directing and or baffling said air gas mixture in its flow from said transition port to said flame ports.

20. A burner as claimed in claim 19, wherein said occluding structures comprise a wall or ridge like formation extending away from the transition port.

21. A burner as claimed in claim 1, wherein said distributor means has at least one air entry port per injector.

22. A burner as claimed in claim 21, wherein each air entry port is formed in a side wall of said distributor means.

23. A burner as claimed in claim 22, wherein said air entry ports have a larger cross sectional area at intermediate regions by comparison to side regions of said air entry ports.

24. A burner as claimed in claim 22, wherein each air entry port is positioned in the wall of said distributor means so as to be located proximate said injector.

25. A burner as claimed in claim 24, wherein each said injector is shielded by a portion of a wall of said distributor means to prevent air passing in through said air entry port from disturbing the operation of said injector.

26. A burner as claimed in claim 22, wherein the distributor includes at least three inwardly extending arms, and wherein said air entry ports are located between respective arms of said distributor means, and wherein respective injectors are located so that they are aligned with the direction of said arm.

27. A burner as claimed in claim 1, wherein the distributor includes at least three inwardly extending arms, and wherein said burner includes a trivet which is aligned with said arms, so as to overlie said arms.

28. A burner as claimed in claim 1, wherein the distributor includes at least three inwardly extending arms, and wherein said arms have a flame port arrangement whereby the axis of said flame ports on a respective arm is generally at an acute angle to the direction of a respective arm.

29. A burner as claimed in claim 1, wherein the distributor includes at least three inwardly extending arms, and wherein said arms extend away from said distributor means for at least a part of the length of the arm at an angle of inclination or declination away from an imaginary horizontal plane.

30. A burner as claimed in claim 1, wherein said distributor means is mounted on a manifold including a gas inlet which communicates with a cavity in said manifold, each of said injectors being in fluid communication with the cavity to receive gas supply from the cavity.

31. A burner as claimed in claim 30 wherein a wall of said cavity is shaped such that the height of said cavity at the outer periphery is of a height greater than at the centre of said cavity.

32. A burner as claimed in claim 30, wherein said manifold cavity has its top surface concave in shape.

33. A burner as claimed claim 1, wherein said distributor means has an internal aperture such that the distributor means has an internal and an external perimeter, with inwardly directed ports in said internal perimeter and outwardly directed ports in its external perimeter.

34. A burner as claimed in claim 16, wherein each venturi extension is oriented so as to be generally horizontal.

35. A gas burner as claimed in claim 1, comprising one distributor means having at least three discrete distribution chambers therein, each chamber having communication with flame ports and including a venturi system to supply an air gas mixture thereto; said burner having a single manifold to conduct gas to respective injectors for each venturi system from a single gas supply connection to said manifold, each of said chambers having a transversely extending channel, which projects into an inner aperture of said burner, whereby between the ends of respective inwardly extending channels there is provided an unobstructed space.

36. A gas burner as claimed in claim 35, wherein each transversely extending channel includes at least two sides which are generally parallel.

37. A gas burner as claimed in claim 35, wherein each chamber also includes two oppositely extending circumferential or arcuate channels.

38. A gas burner as claimed in claim 35, wherein said chamber also includes an outwardly projecting channel.

39. A gas burner as claimed in claim 38, wherein said burner includes a cap.

40. A gas burner as claimed in claim 39, wherein the distributor means or said cap includes a multiplicity of said flame ports.

41. A gas burner as claimed in claim 40, wherein said flame ports are formed by a combination of formations located on said distributor means and said cap.

42. A gas burner as claimed in claim 35, wherein each distribution chamber includes at least three venturi extensions which each define two peripheral channels and a transverse channel to deliver air gas mixture to flame ports.

43. A gas burner as claimed in claim 39, wherein said cap includes at least three venturi extensions which extends into said chamber to define a radial channel and two peripheral channels to deliver air gas mixture to flame ports.

44. A gas burner as claimed in claim 35, wherein each said venturi system includes a vertical passage which opens into at least one generally horizontal venturi extension which extends away from said vertical passage in the direction of each distribution channel of said chamber.

45. A gas burner as claimed in claim 39, wherein each generally horizontal venturi extension is formed in said distributor means and/or in an underside of the cap.

46. A burner as claimed in claim 35, wherein said distributor means is an assembly of separate or discrete segments which are assembled or otherwise joined together.

47. A burner as claimed in claim 46, wherein said separate or discrete segments include interlocking formations thereon so that adjacent burner segments can be assembled together.

48. A burner as claimed in claim 46, wherein said separate or discrete segments are held together as an assembly by means of a interaction with a burner cap.

49. A burner as claimed in claim 46, wherein a circumferential fixing means assists in holding or holds said separate or discrete segments together as an assembly to form a distributor.

50. A gas burner including a distributor means consisting of three chambers to distribute an air gas mixture around said distributor means, said burner including a plurality of flame ports through which said gas mixture can pass and be ignited; each chamber having an associated injector, each injector being positioned to inject gas into its associated chamber via a respective vertically directed converging passage terminating with an transition port which has communication with said chamber, a venturi being formed in part by said converging passage and said transition port with a final part of said venturi being formed by at least one venturi extension which acts upon a generally horizontal flow of said air gas mixture flowing from said transition port, said transition port having at or near its rim two or more occluding structures associated therewith for directing and or baffling said air gas mixture in its flow from said transition port to said flame ports.

51. A burner as claimed in claim 50, wherein said occluding structures comprise a wall or ridge like formation extending away from said protrusion and or said protrusion extensions.

52. A burner as claimed in claim 50, wherein said occluding structures have a castellated appearance.

53. A burner as claimed in claim 50, wherein said occluding structures are formed on said distributor means or in a cap associated with said distributor means or by a combination of both.

54. A burner as claimed in claim 50, wherein said flame ports are formed on said distributor means or in a cap associated with said distributor means or by a combination of both.

55. A burner as claimed in claim 50, wherein extending away from said transition port there are at least two venturi extensions.

56. A burner as claimed in claim 50 wherein said occlusion structures are located near to the edges of said venturi extensions.

57. A burner as claimed in claim 35, wherein the manifold includes upper and lower disc-shaped walls sealed together at their perimeters to define an internal cavity via which gas is delivered to each injector.

* * * * *

UNITED STATES PATENT AND TRADEMARK OFFICE

CERTIFICATE OF CORRECTION

PATENT NO. : 8,408,897 B2
APPLICATION NO. : 10/597348
DATED : April 2, 2013
INVENTOR(S) : Rossi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 867 days.

Signed and Sealed this
First Day of September, 2015

Michelle K. Lee

Michelle K. Lee
*Director of the United States Patent and Trademark Office*